United States Patent [19]

Buckley

[11] Patent Number: 5,039,095

[45] Date of Patent: Aug. 13, 1991

[54] TEN PIN BOWLING APPARATUS

[76] Inventor: David L. Buckley, 4 Claude Street, West End, Townsville, Australia, 4810

[21] Appl. No.: 455,407

[22] PCT Filed: May 9, 1988

[86] PCT No.: PCT/AU88/00134

§ 371 Date: Dec. 28, 1989

§ 102(e) Date: Dec. 28, 1989

[87] PCT Pub. No.: WO88/08736

PCT Pub. Date: Nov. 17, 1988

[30] Foreign Application Priority Data

| | | | |
|---|---|---|---|
| May 8, 1987 | [AU] | Australia | PI1825 |
| Jun. 12, 1987 | [AU] | Australia | PI2448 |
| Oct. 6, 1987 | [AU] | Australia | PI4746 |

[51] Int. Cl.[5] ..... A63D 5/08

[52] U.S. Cl. ..... 273/43 D; 273/42 A; 273/46

[58] Field of Search ..... 273/37, 42 R, 42 A, 273/43 R, 43 A, 43 D, 43 E, 46, 48

[56] References Cited

U.S. PATENT DOCUMENTS

| | | | |
|---|---|---|---|
| Re. 27,416 | 7/1972 | Walsh | 273/43 A |
| 2,338,708 | 11/1945 | Bates . | |
| 2,550,919 | 5/1951 | Frye | 273/42 A |
| 2,920,891 | 1/1960 | Sherman | 273/43 A |
| 3,333,849 | 8/1967 | Schmid | 273/42 A |

FOREIGN PATENT DOCUMENTS

| | | |
|---|---|---|
| 2022939 | 12/1971 | Fed. Rep. of Germany . |
| 306671 | 7/1955 | Switzerland . |

*Primary Examiner*—Edward M. Coven
*Assistant Examiner*—William M. Pierce
*Attorney, Agent, or Firm*—Fleit, Jacobson, Cohn, Price, Holman & Stern

[57] ABSTRACT

A pin setting apparatus for a ten pin bowling apparatus comprises a parallelogram linkage assembly which carries a plurality of pin engaging devices and which may be moved between an expanded attitude, wherein the pin engaging devices are arranged at desired locations of pins on the pin deck of the bowling apparatus, and a contracted attitude, wherein pins may be collected from a pin supporting assembly. The linkage assembly is movable between a position overlying the pin deck for depositing or collecting pins and a position spaced from the pin deck for collection of pins from the pin supporting assembly.

22 Claims, 21 Drawing Sheets

111
112
113
114
115
116
117
118
119
120
105
123
175
12
18
F
E
L

TEN PIN BOWLING APPARATUS

TECHNICAL FIELD

This invention relates to improvements to ten pin bowling apparatus and in particular to improved pinsetting apparatus and associated mechanisms.

BACKGROUND ART

Ten pin bowling pinseting machines which are currently available and in use are arranged to be mounted on the kickbacks at the sides of a bowling lane so as to be located above the pindeck and pit area. Such machines which perform the function of elevating, storing and transferring pins prior to setting them on the pindeck physically obstruct the pindeck and pin areas so that access thereto is difficult particularly during resurfacing and other maintenance tasks such as cleaning and repair resulting in high labour costs for maintenance purposes. Furthermore, the known machines cause visual obstruction of the pindeck thereby limiting filming and observation opportunities.

Generally the above machines incorporate arrangements for lifting bowling balls which operate by means of belts or friction drives. This can result in friction damage to the bowling balls as well as high maintenance due to ball spins caused by lane conditioner, undersize bowling balls or poor adjustments. Some of the known machines are also provided with rolling pit carpets which use roller drives, however, such carpets suffer from extensive and rapid wear caused by misalignment so that the entire carpet assembly is required to be removed from the pit for cleaning, repair or replacement.

DISCLOSURE OF INVENTION

The present invention aims to overcome or alleviate one or more of the above disadvantages by providing improved apparatus for ten pin bowling which provides clear physical and visual access to the pindeck and pin areas, and which thereby reduce cost of maintenance. The present invention also aims to provide in a further aspect, apparatus which incorporates a pit carpet assembly which is subject to reduced wear and which may be removed and replaced rapidly and efficiently. The present invention also aims in a further aspect to provide apparatus which incorporates efficient means for the lifting and returning of bowling balls which reduces the risk of damage thereto. Other objects and advantages of the invention will become apparent hereunder.

With the above and other object in view, the present invention provides ten pin bowling apparatus including pin setting apparatus comprising pin engaging means for placing pins on a pin deck and removing standing pins therefrom, and means for moving said pin engaging means from a first attitude spaced from said pin deck wherein said pin engaging means may engage pins displaced from said pin deck and a second attitude wherein said pin engaging means is disposed over said pin deck for placing said pins thereon or removing pins therefrom.

Preferably the pin engaging means includes a plurality of pivotal link members which carry actuable pin gripping jaws and which when moved over the pin deck are aligned with pins on the pin deck or required positions of the pins. Suitably the pivotal link members are in the form of interconnected scissor type links and the pin jaws are pivotally mounted on supports attached to the links and are actuable for movement towards each other to grip the pins and away from each other to release the pins.

Preferably the pin setting apparatus includes an upstanding support at the rear of the pin deck and gantry means projecting from the support and over the pin deck to guide movement of the pin engaging means. Suitably the means for moving the pin engaging means comprises drive means which preferably includes an expandable and retractable scissor linkage for moving the pin engaging means along the gantry.

The gantry is preferably mounted for vertical movement along the support for lowering and raising the pin engaging means suitably by means of a further scissor linkage.

Pins which are displaced from the pin deck are directed by a endless pit carpet assembly onto an elevator for placement into respective cups on a pin support with the cups arranged to be aligned with respective jaws of the pin engaging means so that the latter may engage pins in the cups for placement on the pin deck.

Suitably the pit carpet assembly is in the form of a carpet fitted at each end with co-operative engagement means so as to be of endless form and the carpet is supported by rollers and at opposite edges is secured to links of endless chains supported about sprockets coaxial with the rollers.

The ball lifting means preferably includes a cradle for receiving the ball and sensing of receipt of the ball in the cradle results in elevation of the cradle so that the ball may be deposited into a track for return along the lane to the bowler.

The apparatus also incorporates a rake assembly which is operated to rake pins from the pin deck onto the pit carpet assembly and the rake assembly is suitable actuated by scissor linkage controlled by a rotating crank.

Whilst the preferred actuating mechanisms for components of the apparatus are in the form of scissor linkages, other actuating mechanisms such as a rack and pinion mechanism, hydraulic or gas operated telescopic sections, or worm driven mechanisms.

BRIEF DESCRIPTION OF DRAWINGS

Reference will now be made to the accompanying drawings which illustrate a preferred embodiment of the invention and wherein.

Figure 1:
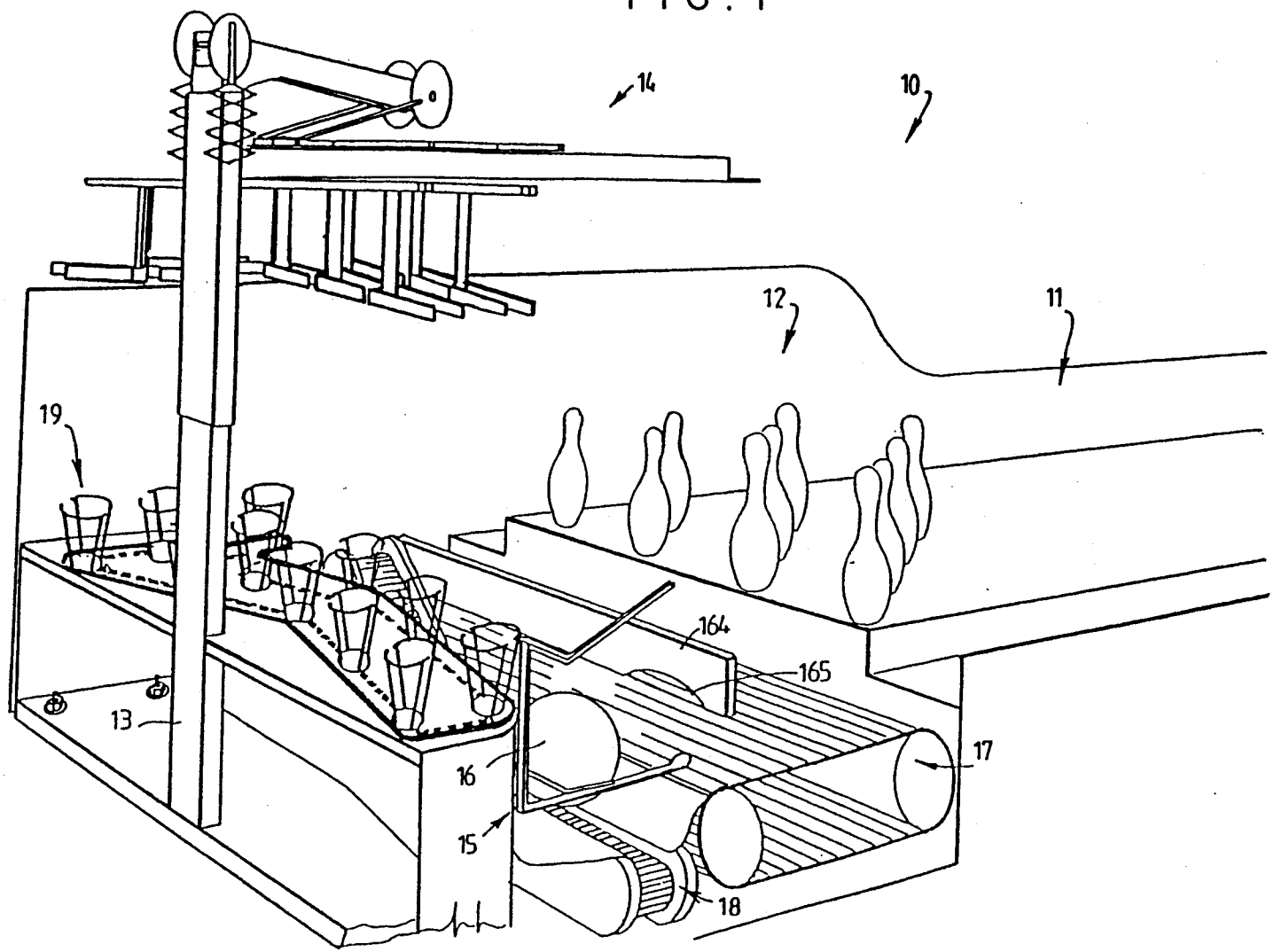
FIG. 1 is a schematic view of the apparatus of the invention with the ten pins located on the pin deck.

Referring to the drawings and firstly to FIG. 1 there is illustrated apparatus 10 according to the invention which is located at the end of a ten pin bowling lane 11 and which is arranged to place pins 12 for ten pin bowling in the required triangular configuration on the pin deck at the rear of the lane 11. For this purpose the apparatus 10 includes an upstanding support stem 13 arranged centrally of the lane and a pin elevating and collection mechanism 14 which is arranged to move along the stem 13 and which incorporates means for alignment with, and for gripping respective pins 12.

Figure 44:
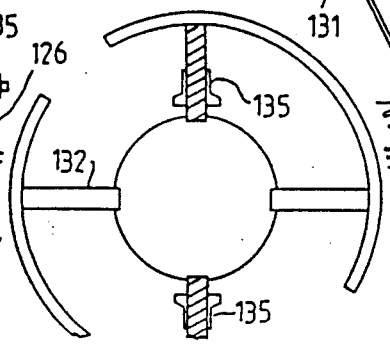

The apparatus 10 also incorporates a ball lifting mechanism 15 which is arranged to receive ten pin bowling balls 16 and return same to the opposite end of the lane 11. Also included in the apparatus 10 is a pit carpet assembly 17 which directs pin 12 knocked from the pin deck to a pin elevator assembly 18 which is arranged to deposit collected pins 12 into a pin support assembly 19 from which the pins 12 are collected by the elevator assembly 14. The apparatus 10 further incorporates a rake assembly 20 (see FIGS. 42 to 44) which is arranged to rake pins 12 from the pin deck onto the carpet assembly 17.

Figure 4:
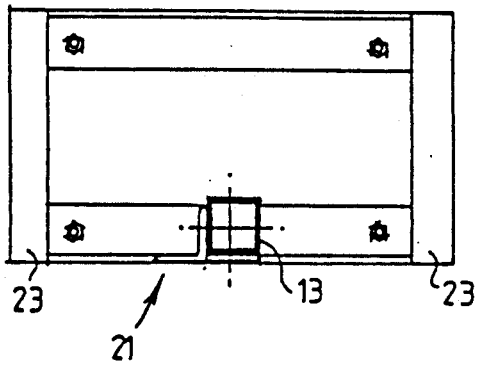
FIG. 4 is plan view of the support stem.
Figure 2:
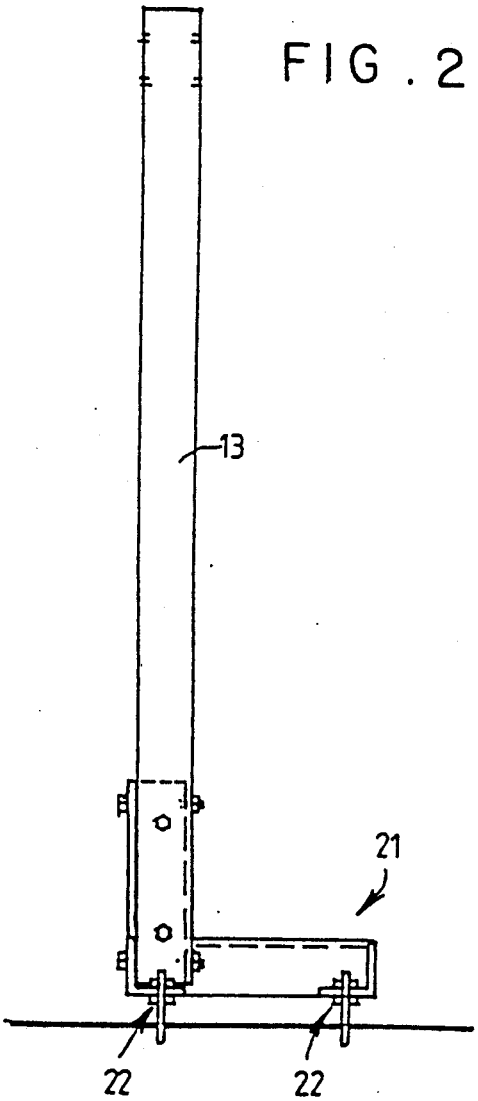
FIGS. 2 and 3 are respective side and rear elevational views of the support stem of the pin setting assembly.
Figure 3:
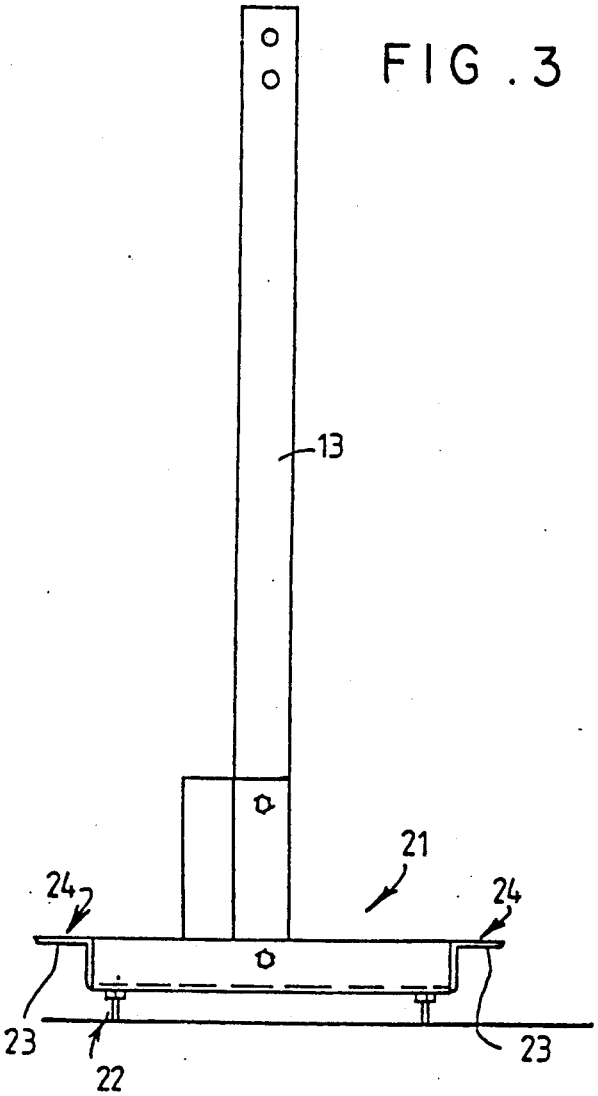

As shown more clearly in FIGS. 2 to 4 the support stem 13 is of hollow square sectioned form and is supported and braced by angled sections which form a bracket 21 which is adjustable mounted on a ground surface by means of the bolting arrangements 22 so that the stem 13 may be adjusted to the desired vertical attitude and it will be apparent from FIG. 2 that stem 13 and associated mechanism may be placed in position and removed by means of a fork lift pallet truck, or similar which may engage with respective opposed flanges 274 of the stem angle brackets 24.

Figures 5, 6:
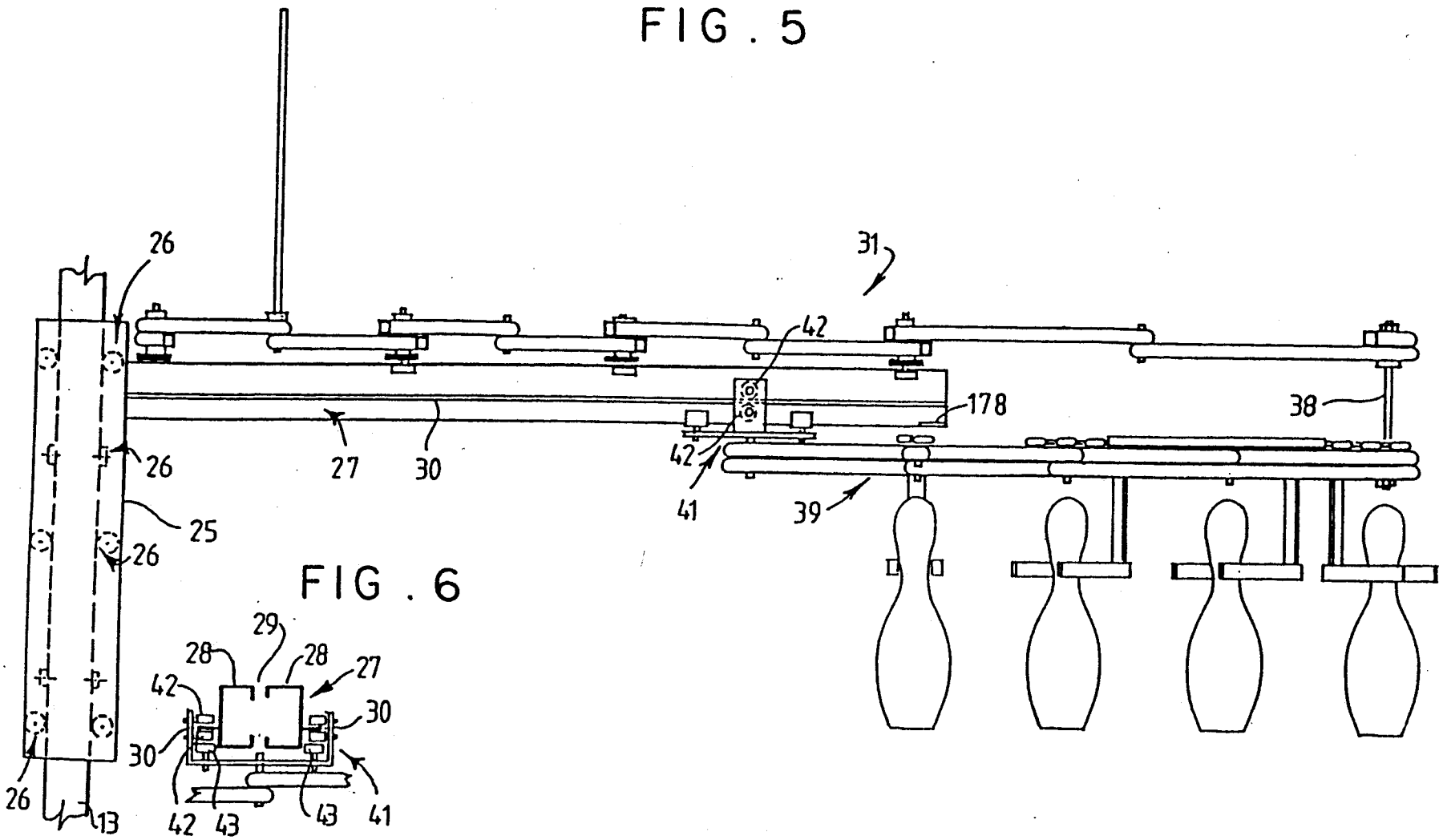
FIG. 5 is a side elevational view of the riser member and associated gantry which is arranged for movement along the support stem.
FIG. 6 is an end view showing details of the gantry.
Figure 9:
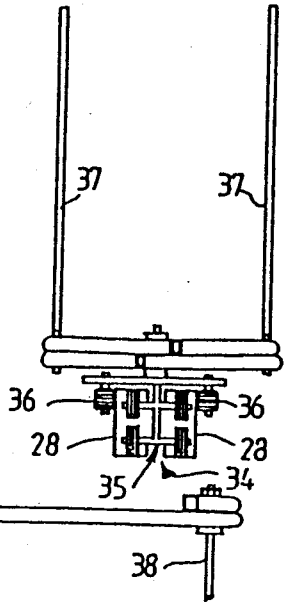
FIG. 9 is a sectional view along line A—A of FIG. 8.
Figure 8:
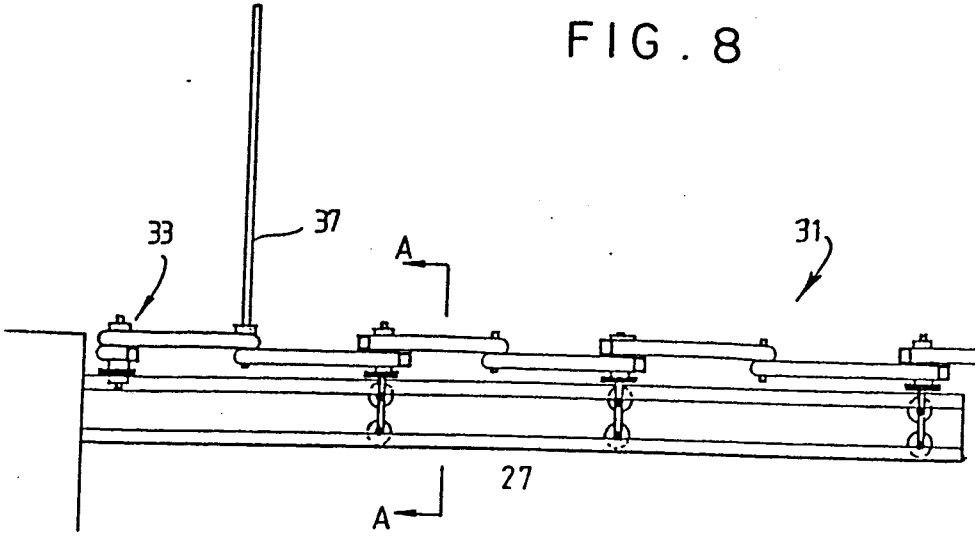
FIG. 8 is a longitudinal sectional elevational view of the mechanism of FIG. 7.
Figure 7:
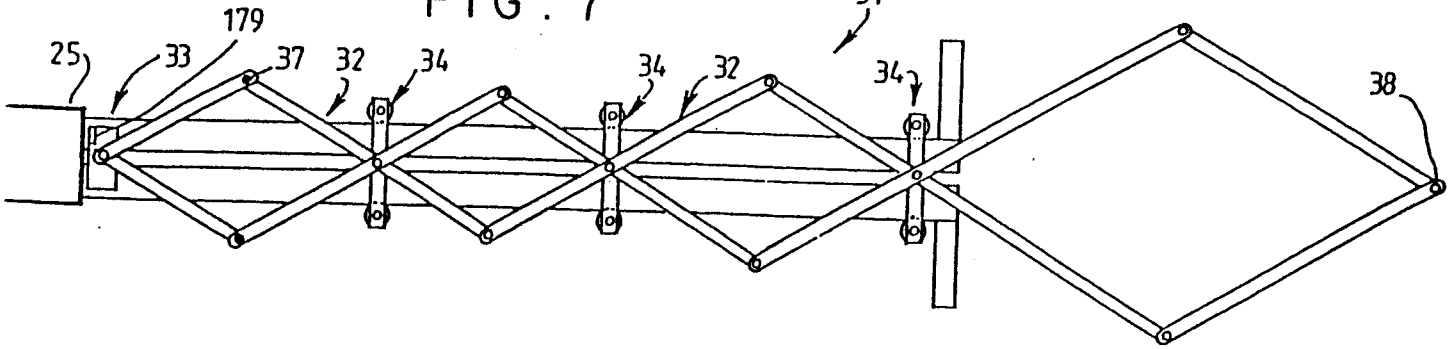
FIG. 7 is a plan view of the extension mechanism extended for placement and removal of pins.
Figure 10:
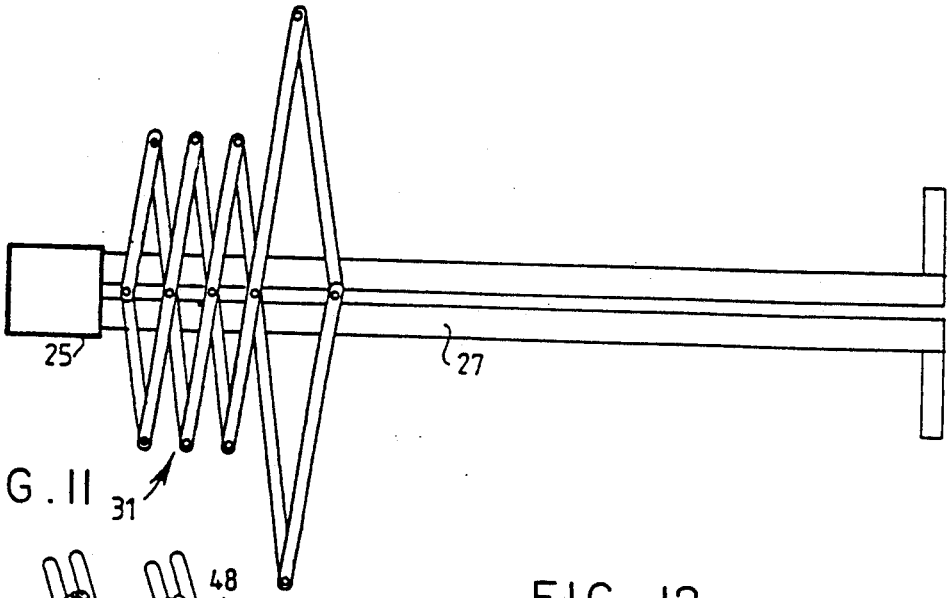
FIG. 10 is a plan view of the extension mechanism in a retracted position.

The pin elevating assembly 14 includes as shown in FIG. 5, a hollow rectangular section riser member 25 which is of slightly greater size than the stem 13 and which is arranged to be moved therealong. The riser member 25 is provided with a plurality of sets of rollers 26 which engage with respective side walls of the riser stem 13 so that the riser member 25 is guided for smooth movement along the stem 13. Fixed to the riser member 25 and extending outwardly therefrom is a gantry 27 which as shown in FIG. 6 comprises a pair of opposed C-sectioned members 28 which are spaced apart to define a elongated slot 29 therebetween and which include on their outer faces respective longitudinally extending flanges 30 which serve as tracks in the manner described below.

As shown in FIGS. 7 to 10 the apparatus 10 includes a extension mechanism 31 which may be activated to move and retrieve the pins from an extended position. The mechanism 31 includes a plurality of sets of pivotally interconnected scissor linkages 32 which are pivotally fixed at one end 33 adjacent to the riser member 25 and which are guided in their extending the retraction movements along the gantry 27 by respective roller asemblies 34 which include a tree-like bracket member 35 which carries a plurality of rollers 36 which locate within and engage opposite faces of the C-sectioned members 28 as well as the opposite side faces thereof. It will be apparent from FIGS. 7 to 9 that upon retraction and expansion of the scissor linkages, the roller assemblies 34 will move along and within the C-sectioned members 28. The extension mechanism 31 also includes at their inner ends a pair of upstanding actuation members 37 which function in a manner described hereunder and a single downwardly extending drive arm 38 at its outer end which is connected by means of nuts at opposite threaded ends to the pin linkage assembly 39 (see FIGS. 5, 11 and 12).

Figure 11:
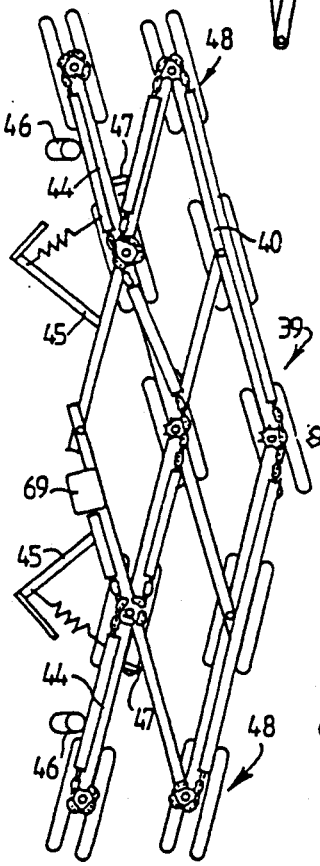
FIGS. 11 and 12 are plan views of the pin gripping linkage assembly in a retracted and extended position respectively.
Figure 12:
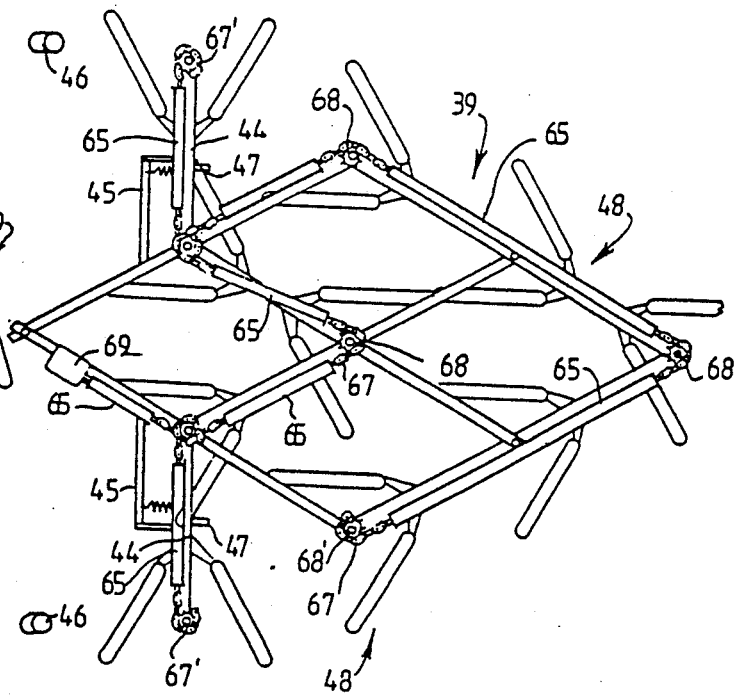
Figure 13:
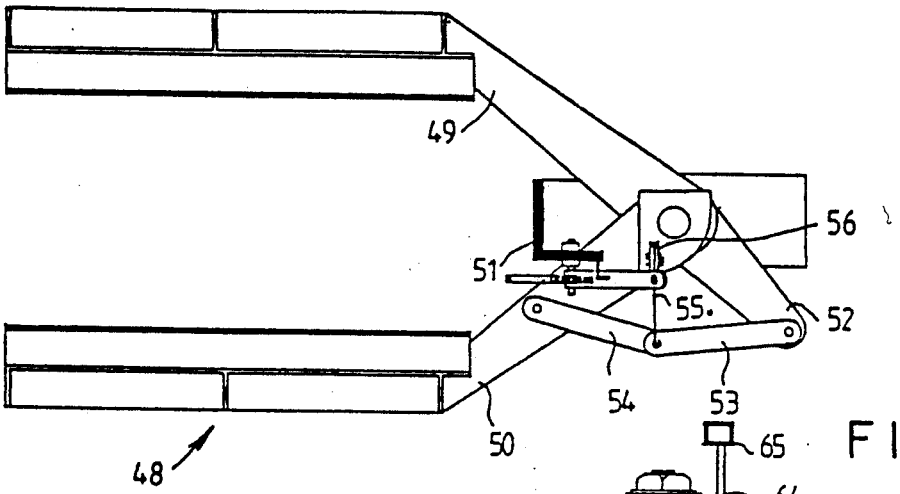
FIGS. 13 to 15 are plan side and rear views of a pin gripper with the jaws open.
Figure 15:
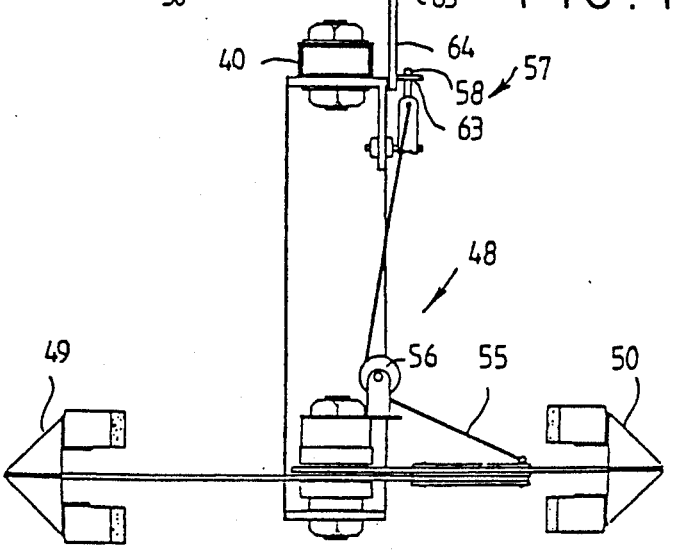
Figure 14:
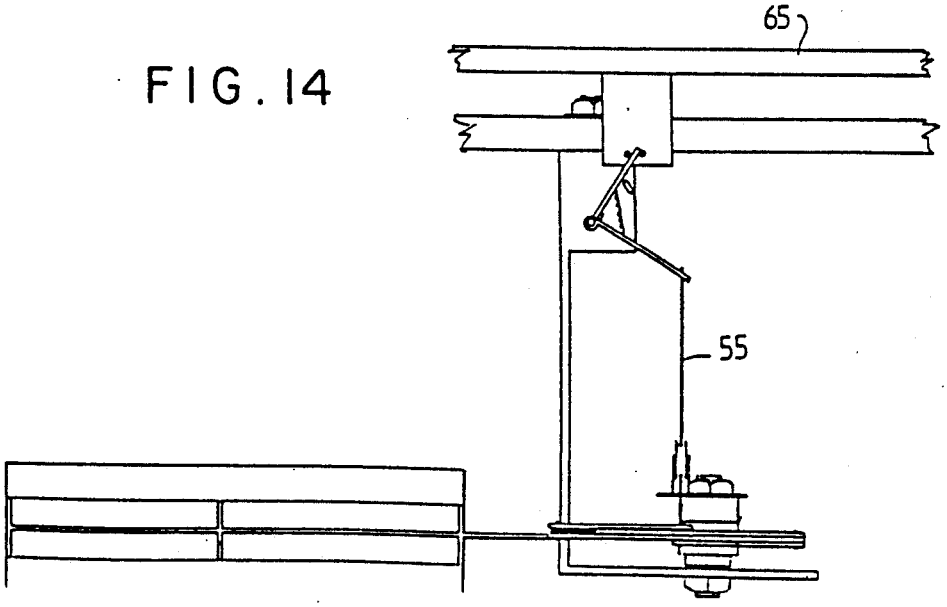
Figure 16:
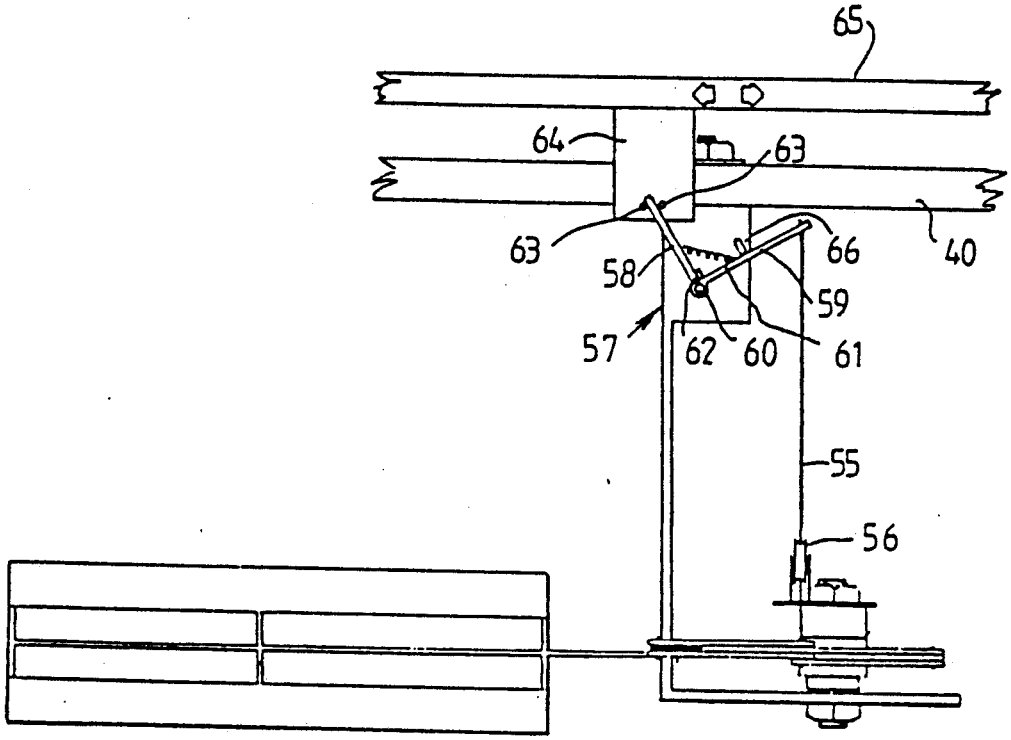
FIGS. 16 and 17 are side views of the pin gripper in a closed position and in a pin gripping position respectively.
Figure 17:
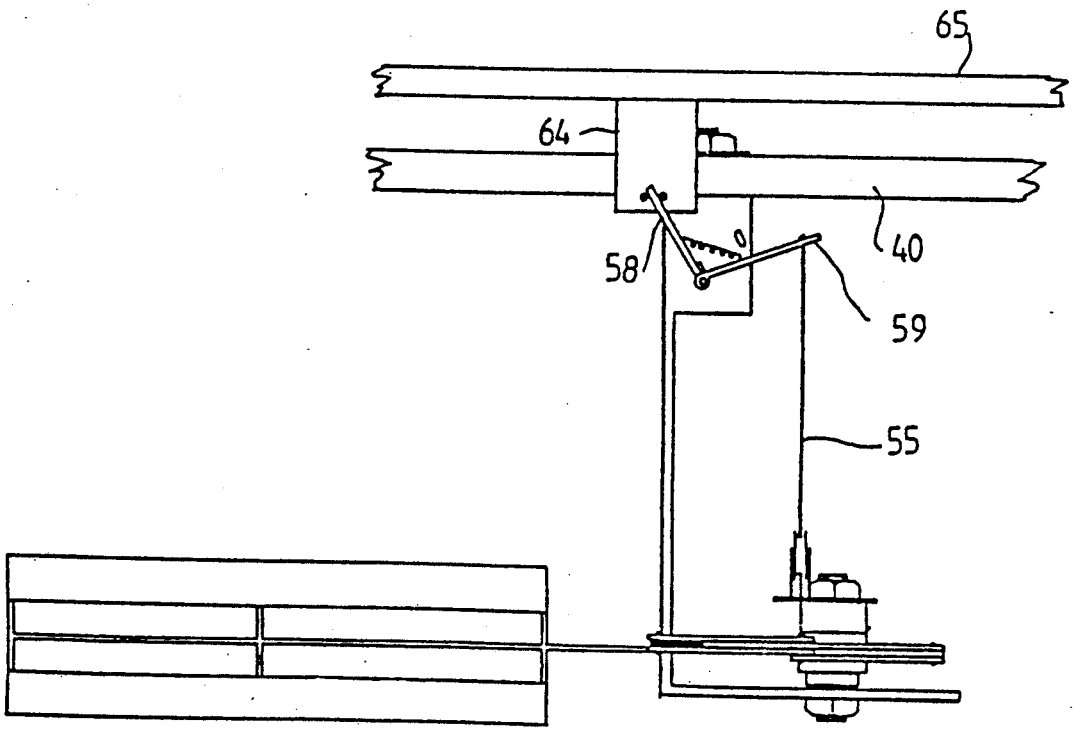
Figure 18:
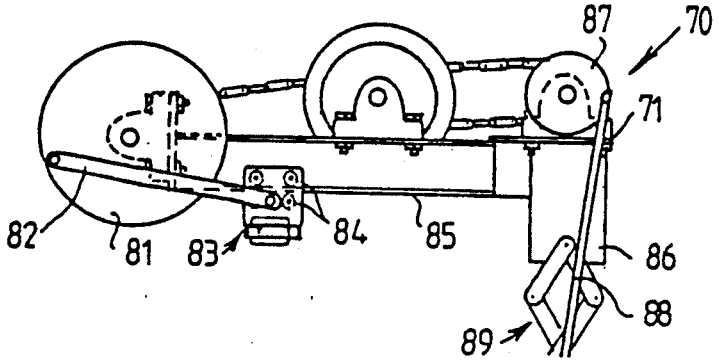
FIG. 18 is a side elevational view of the drives and transmissions for the drive mechanism and for elevation of the riser member.
Figure 19:
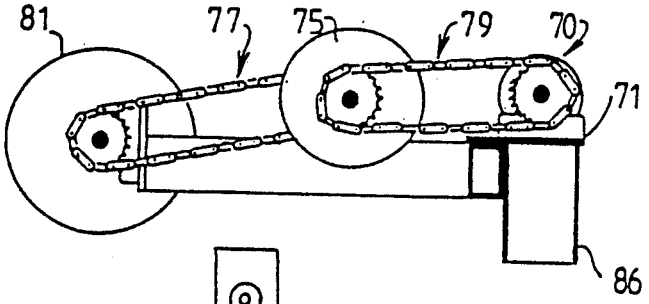
FIG. 19 is a sectional view showing details of the drives and transmissions.
Figure 20:
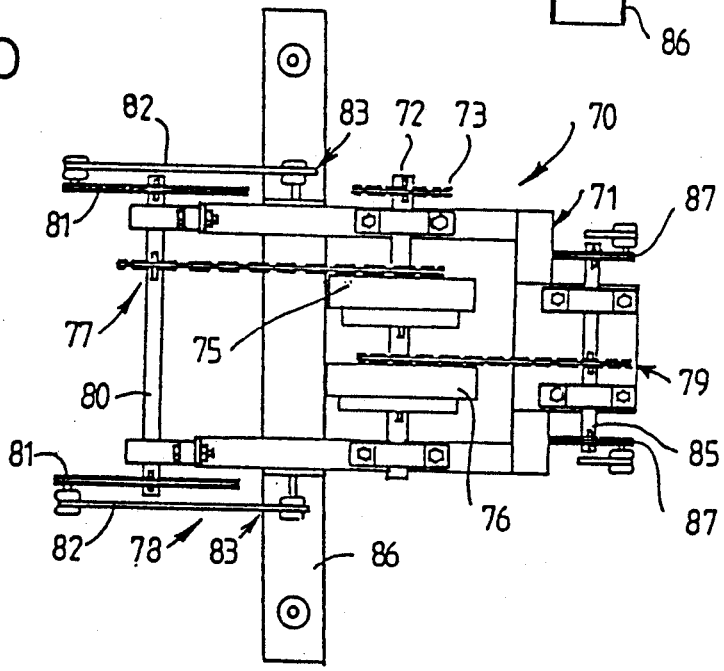
FIGS. 20 and 21 are plan and front views of the drives and transmissions of FIGS. 18 and 19.
Figure 21:
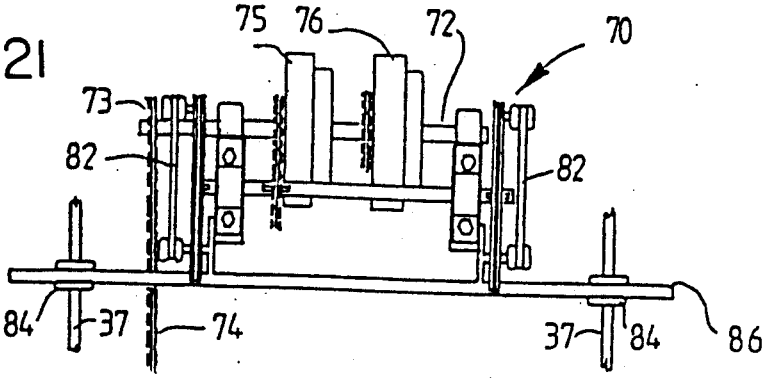

The pin linkage assembly 39 includes a plurality of pivotally interconnected parallelogram links 40 which may move between the retracted position shown in FIG. 11 and the extended position shown in FIG. 12. The linkage assembly 39 at its inner ends is supported by a carriage 41 which is arranged for sliding movement along the gantry 27. For this purpose the carriage 41 (as shown in FIGS. 5 and 6) includes two pairs of opposed rollers 42 which are disposed on opposite sides of the flanges 30 and also includes further pairs of rollers 43 which engages opposite faces of the members 28. The linkage assembly 39 as shown includes a pair of side arms 44 pivotally connected to the main side links 40 for setting pins 7 and 10. The arms 44 are spring biased towards stops 45 fixed to the side links 40. Further fixed upwardly inclined stop members 46 are provided and engaged by the arms 44 on retraction of the linkage assembly 39 so that the spring force is overcome permitting the arms 44 to move to the FIG. 11 position. Further stops 47 on the arms 44 limit the retraction movement of the arms 44.

The pin linkage assembly 39 carries ten pin grippers 48 which in the FIG. 11 attitude are disposed in substantial alignment with the required positions of the pins 12 on the pin deck whilst in the FIG. 12 attitude the grippers 48 are aligned with pins 12 held in the pin support assembly 19.

As shown in FIGS. 13 to 17 each pin gripper 48 includes a pair pivotally interconnected jaws 49 and 50 which are mounted on a support bracket 51, fixed to and extending downwardly from a link 40 of the linkage assembly 39 at the desired locations referred to above. One jaw 49 includes an extended arm portion 52 and a pair of pivotally interconnected links 53 and 54 are connected pivotally to the arm 52 and jaw 50. A cable 55 passes from the pivotal connection of the links 53 and 54 about a guide roller 56 supported on the bracket 51 to be fixed to an operating linkage 57. The linkage 57 includes a pair of members 58 and 59 pivotally mounted at one end about a common axis 60 and which includes a spring 61 which biases the members 58 and 59 towards each other with this movement being limited by a stop 62 on the member 59. The free end of the arm 58 is located between a pair of abutment pins 63 which are mounted on a plate 64 fixed to an actuating member 65. It will be apparent from FIGS. 14 to 17 that movement of the actuating member 65 in opposite directions will cause corresponding pivotal movement of the members 58 and thus through the cable 55 opening and closing of the jaws 48 and 49. If a pin 12 is gripped by the jaws, the member 59 will only move to a limited extent with the member 58 after which the member 58 will move away from the member 59 due to the spring connection therebetween (see FIG. 17). If a pin is not located between the jaws 48 and 49 the member 59 will strike and cause actuation of a micro switch 56 mounted on the bracket 47 (see FIG. 16).

As shown in FIGS. 11 and 12 the actuating members 65 for the jaws extend generally along the links 40 and are interconnected by a chain 67 which are supported about sprockets 67 rotatably mounted at the pivot connection points of the links 40. The chain 67 is positively connected at each end to a solenoid 69 and to the final sprocket 68'. At the pivot connections of the arms 44, ganged sprockets 68 are provided and short chains 67' connected to the lower sprockets at one end and sprockets at the free ends of the arms 44. It will be apparent that actuation of the solenoid 69 will cause movement of the chains 67 and 67' and movement of the actuating members 65 and thereby closure of the jaws 49 and 50 in the above described manner.

Referring now to FIGS. 18 to 23 there is illustrated the drive mechanism 70 for causing reciprocation of the linkage assembly 31 and thereby extension and retraction of the pin linkages 39. The drive mechanism 70 includes a bracket assembly 71 which seats on the top of the stem 13 and which supports in bearings a horizontally extending main shaft 72 which carries at one end a sprocket 73 linked by a chain 74 to the main drive motor. Also mounted on the shaft 72 are a pair of clutches 75 and 76, one 75 of which may be actuated to transmit rotary motion from the shaft 72 through a chain and sprocket drive 77 to the reciprocating mechanism 78 of the scissor linkages assembly 31 and the other clutch 76 of which is arranged to be actuated to transmit drive from the shaft 72 through a chain and sprocket transmission 79, to elevate or retract the riser member 25.

The reciprocating mechanism 78, includes a horizontal shaft 80, which carries it each end, respective cranks 81, which are linked via a linkage member 82 with a slide 83 provided with rollers 84 to enable the slide 83 to reciprocate along a flange 85 of the bracket 71. Fixed for movement, with the slide 83 is an arm 86 which extends to opposite sides of the slides 83 and carries bearings 84, to receive respective actuating arms 37, for the linkage assembly 31. Thus rotation of the cranks 81 will cause reciprocation of the slides 83 and consequent reciprocation of the arm 86 and through the bearings 84, reciprocation of the drive arms 37. This will result in a consequent expansion and retraction of the linkage assembly 31 and this advancement of the pin linkages 39 over the pin deck for depositing of pins 12 thereon or the engagement of pins 12 standing on the deck and elevation or removal thereof. It will also be apparent that by virtue of the sliding bearing engagement between the drive arms 37 and bearings 84, drive can be transmitted to the linkage assembly 31 both in the raised, lowered and intermediate positions thereof.

The chain and sprocket transmission 79 for elevating the riser member 25 is coupled to a further generally horizontally shaft 85 mounted in bearings upon portion of the bracket 71 which includes a hollow section 86 which seats on the upper end of the stem 13.

Figure 22:
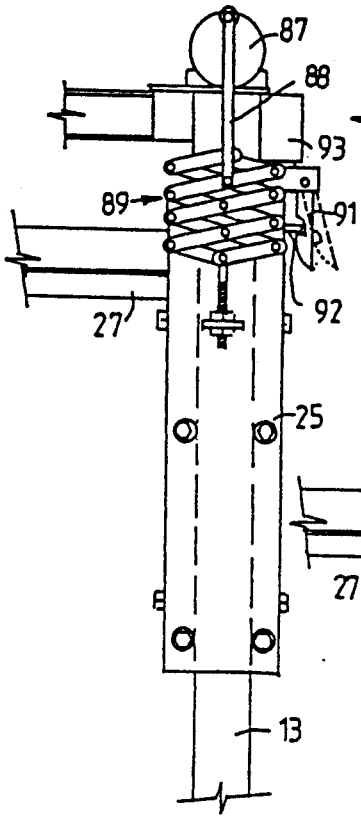
FIGS. 22 and 23 are side and rear elevational views of the elevating mechanism for the riser member.
Figure 24:
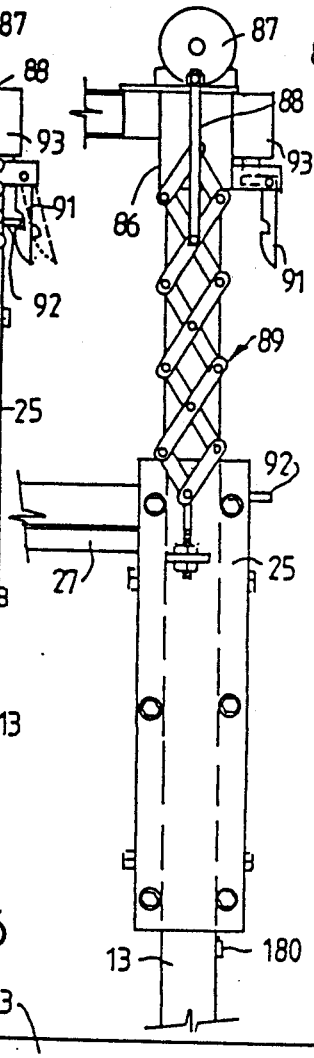
FIG. 24 is a side elevational view of the mechanism of FIGS. 22 and 23 in an extended attitude.
Figure 23:
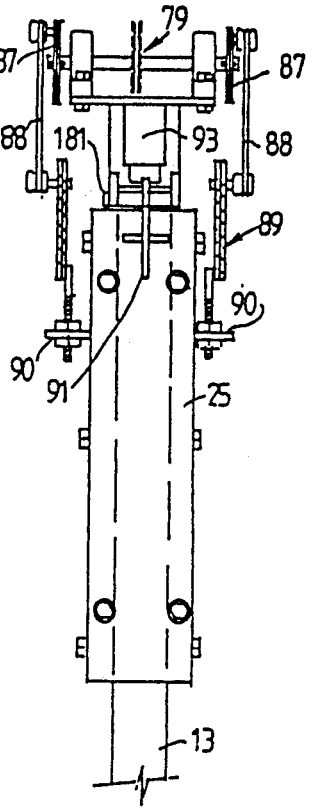

Fixed to opposite ends of the shaft 85 are respective discs 87 to which actuating arms 88 are eccentrically and pivotally attached so that the discs 87 form the function of cranks. The opposite ends of the arms 88 (as shown in FIGS. 22 to 24) are pivotally attached to respective scissor linkages 89 which are pivotally fixed at one end to the hollow section 86 and adjustably at their other end to respective lugs 90 fixed to the riser member 25. Thus rotation of the crank discs 87, which occurs when the clutch 76 is actuated to cause drive to be transmitted to shaft 85, will cause reciprocating motion of the actuating arms 88 and thus expansion and retraction of the scissor linkages 89 and thereby lowering and raising of the riser member 25, gantry 27 and associated mechanisms.

As shown in FIGS. 22 to 24, a spring loaded pivotal latch 91 is also mounted to the hollow section 86 and is adapted to cooperate with a lug 92 on the riser member 25 to lock the riser member 25 in the elevated attitude of FIG. 22 when desired. Operation of the latch 91 is controlled by a solenoid 93 mounted to the section 86.

Figure 25:
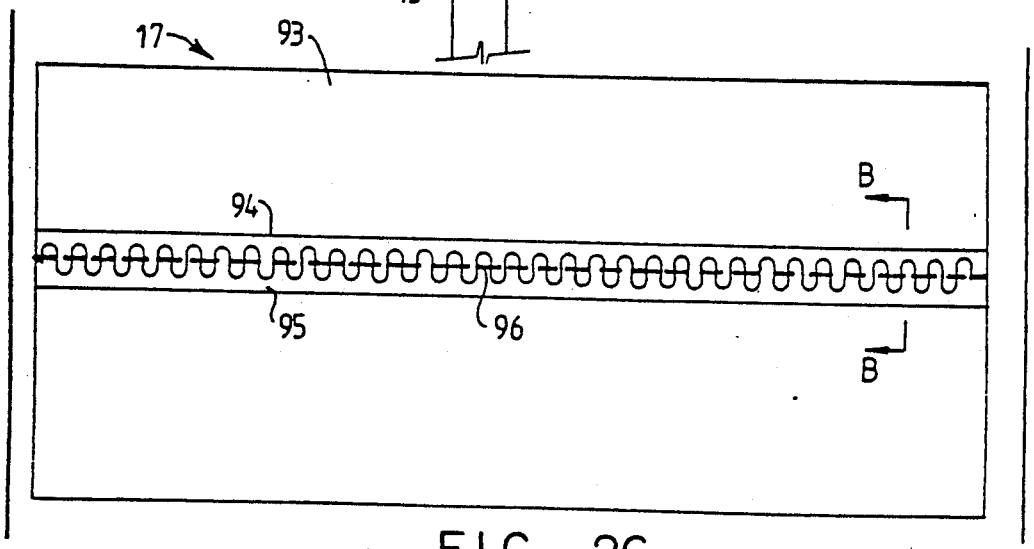
FIG. 25 is a plan view of the pit carpet.
Figure 26:
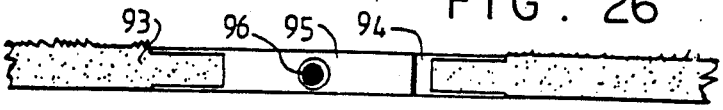
FIG. 26 is an enlarged sectional view along line B—B of FIG. 25.
Figure 27:
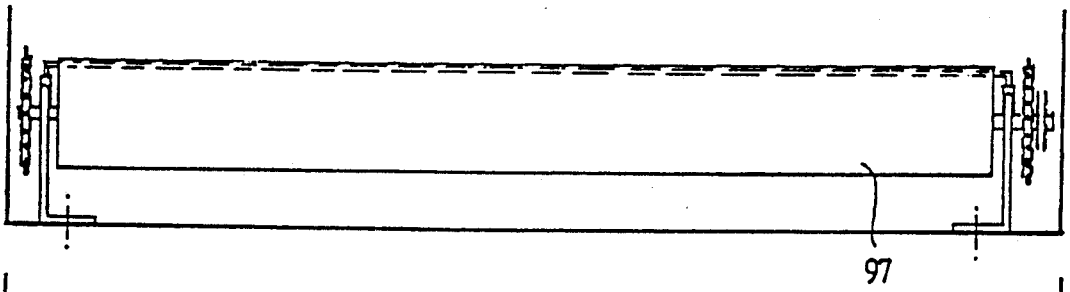
FIGS. 27 and 28 are side and plan views of the pit carpet support rollers.

Pins 12 which are knocked over either through the action of a ball 16 rolled along the lane or by means of the rake assembly 20 fall onto the pit carpet assembly 17 which is inclined to the rear and one side to direct pins 12 onto the pin elevator assembly 18. The pin carpet assembly 17 in this embodiment is as shown in FIGS. 25 and 26, comprised of a length of carpet 93 provided at opposite ends with complementary joining members 94 and 95 which may be interengaged and retained together by joining pin 96 passed through aligned apertures in the respective joining members 94 and 95.

Figure 28:
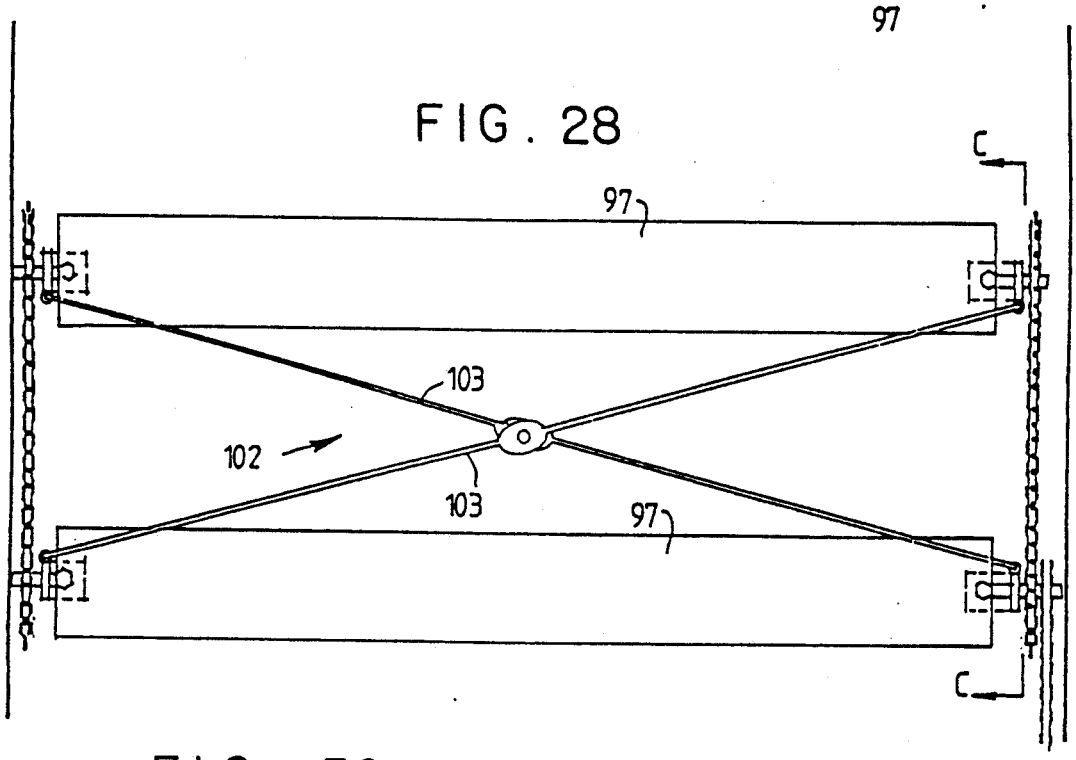
Figure 30:
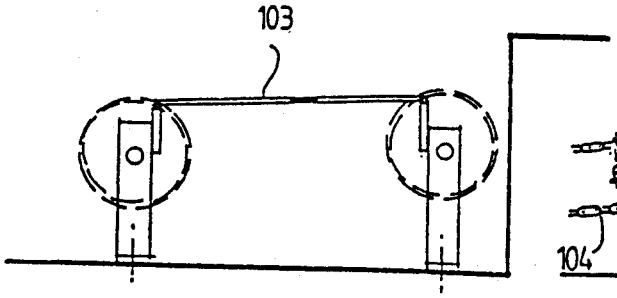
FIG. 30 is a side sectional view along lines C—C of FIG. 28.
Figure 29:
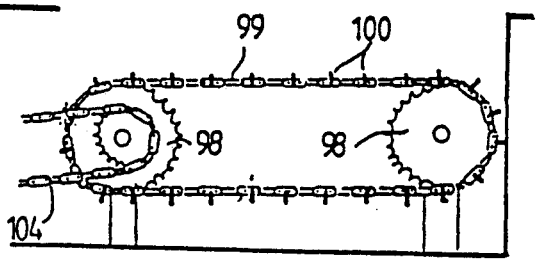
FIG. 29 is a side elevational view of FIG. 28.
Figure 31:
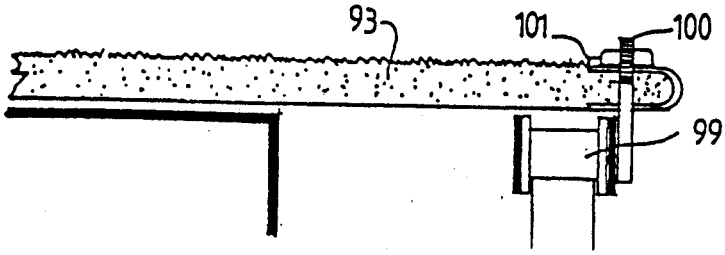
FIG. 31 is an enlarged sectional view showing the connection details at the carpet edge.

The carpet 93 is as shown in FIGS. 28 to 30 supported about a pair of spaced rollers 97 which are provided at each end with sprockets 98 about which respective endless chains 99 pass. A plurality of outwardly extending studs 100 are secured to respective chain links and the studs 100 pass through opposite edges of the carpet 93 to be secured thereto by nuts 101 in the manner shown in FIG. 31.

The upper run of the carpet 93 is also supported by a frame 102 which is in the form of a pair of elongated elements 103 pivotally interconnected in their central region and movable to the extended position of FIG. 28 to locate in apertured lugs ajacent opposite ends of the rollers 97. Drive transmitted to one of the rollers 97 via chain 104 will cause rotation of both rollers 97 via the chains 99 and thus movement of the carpet 93 to move pins 12 thereon onto the elevator assembly 18.

Figure 32:
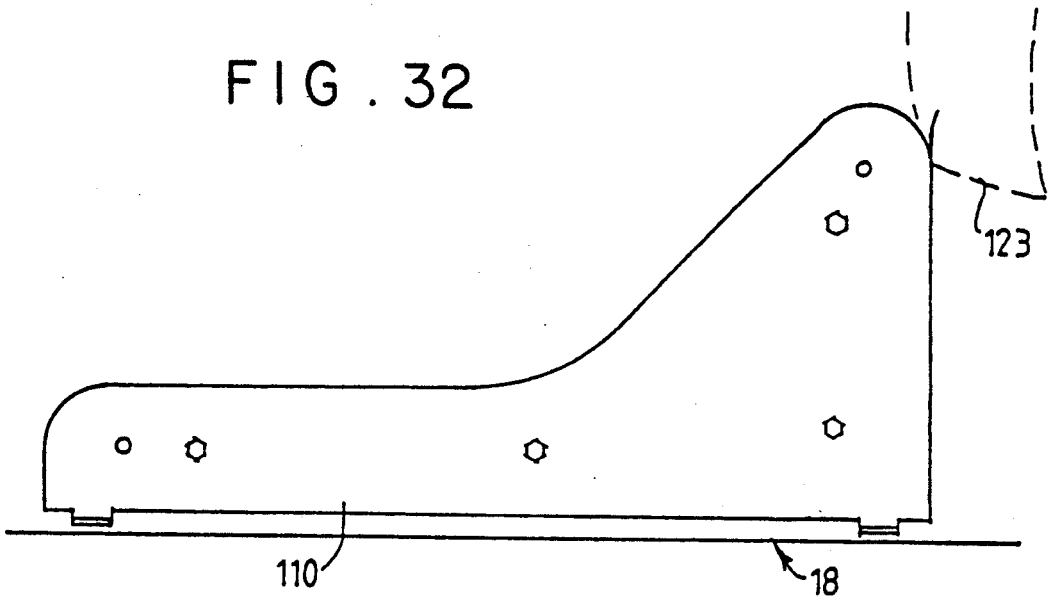
FIG. 32 is a side view of the pin elevator.
Figure 33:
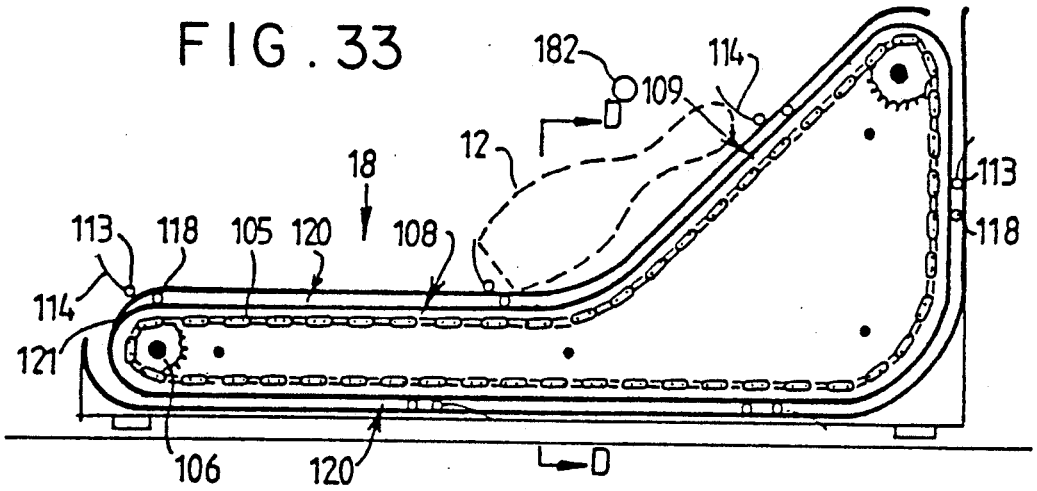
FIG. 33 is a longitudinal sectional view of the pin elevator.
Figure 34:
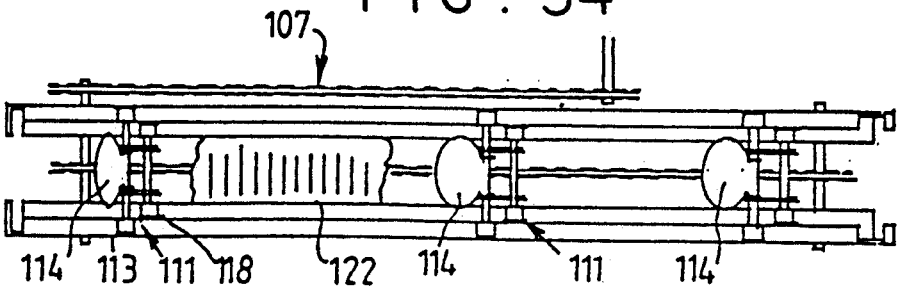
FIG. 34 is a plan view of the pin elevator.

The elevation assembly 18 as shown in FIGS. 32 to 34 includes an endless chain 105 supported about sprockets (one of which 106 is driven, via a chain/sprocket transmission 107) and having a first generally horizontal run 108 leading into an upwardly inclined run 109. The chain 105 is supported between a pair of side plates 110 which include opposite inwardly directed guides which serve to guide movement of pin carriages 111.

Figures 35, 36, 37, 38, 39:
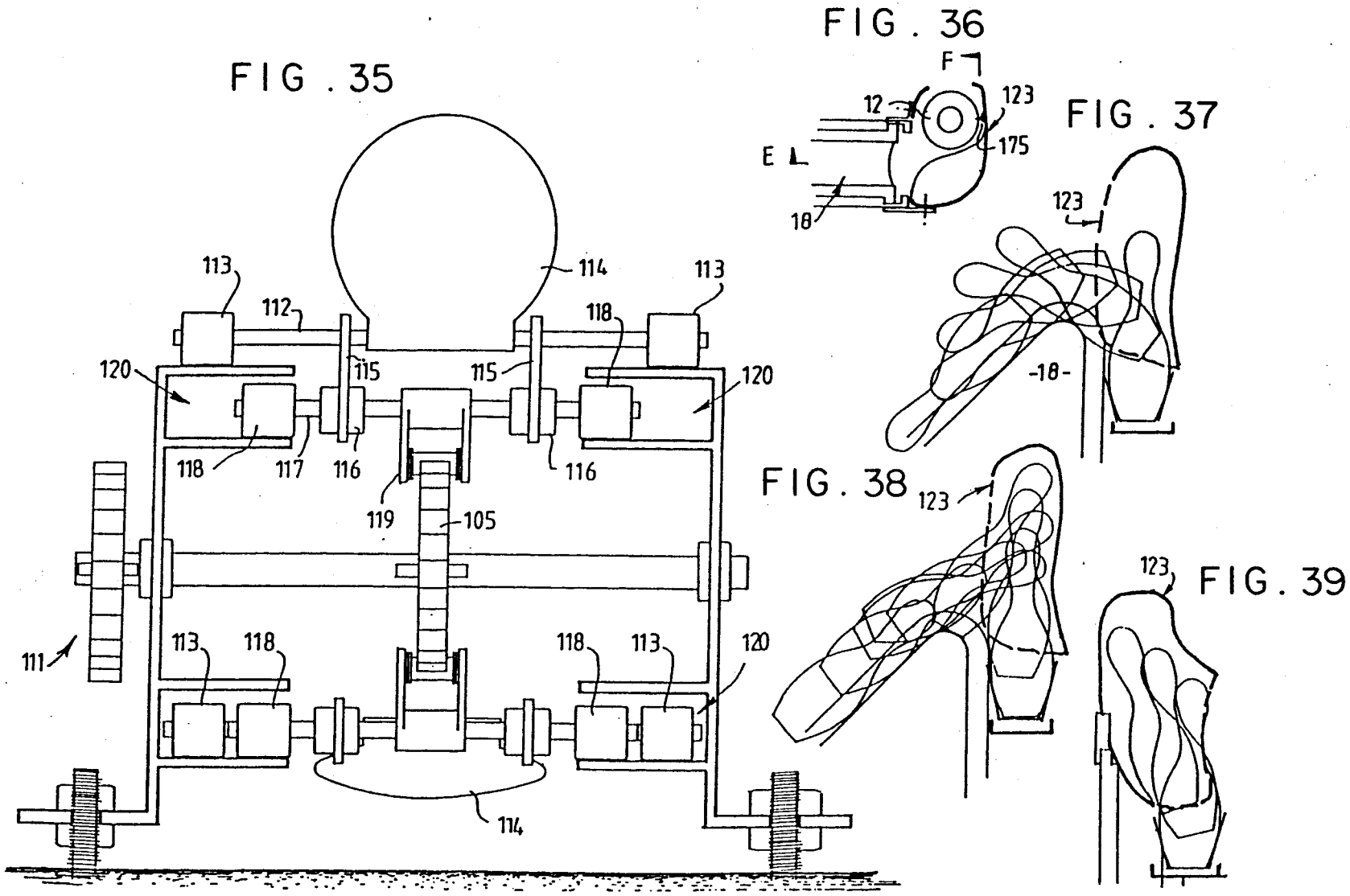
FIG. 35 is an enlarged sectional view along lines D—D of FIG. 34.
FIG. 36 is a plan view of the pin guide chute at the end of the pin elevator.
FIGS. 37 and 38 are views in the direction E of FIG. 36 showing different pin discharges from the elevator.
FIG. 39 is a view in the direction F showing pin discharge.

Each pin carriage will as shown more clearly in FIG. 35 includes a main shaft 112 including a pair of wheels 113 at each end and a flange portion or cup 114 fixed to the shaft. A pair of arms 115 are fixed to the shaft 112 and support in bearings 116 a further shaft 117 which carries wheels 118. The shaft 117 is coupled to a link of the chain 105 via a bracket 119. As shown the guides 120 for the carriage 111 are of channel form and at the top side of the elevator assembly 18, the wheels 118 are located within the channel guides 120 whilst the wheels 113 are located on the top surface of the guides 120 so that the cups or flanges 114 adopt an attitude generally normal to the chain 105 for engaging pins 11. At the upper end of the elevator assembly 18, the upper wheels 113 are directed in between the channel sectioned guides 120 in the manner shown in FIGS. 33 and 35 so as to be located behind the wheels 118 to cause the flanges or cups 114 to adopt the collapsed attitude as shown. The cups 114 will remain in this attitude until the front end of the elevator assembly 18 is again reached whereat the upper flanges of the guides 120 are shaped at 121 to direct the wheels 113 out of the channel back onto those flanges to again erect the cups 114. Preferably a belting 122 of rubber or other material is located between the respective carriages 111 for movement therewith so as to carry the pins 12.

At the upper end of the elevator assembly 18 and as shown in FIG. 36 a pin guide chute 123 is provided to direct pins 12 from the elevator assembly 18 onto the pin support assembly 19. As shown in FIGS. 36 to 37 the guide 123 is of generally hollow form and is shaped to direct pins 12 vertically downwards after receipt from the elevator 18. Pins 12 are deposited onto the elevator 18 to either lie longitudinally between the cups or flanges 114 with their tops forward or their bases forwards.

When pins 12 with their tops forward reach the upper end of the elevator 18 they are guided into a generally vertical attitude by the guide 123 after which they fall onto the pin support assembly 19 in the manner shown in FIG. 38. Pins 12 with their bases forward simply fall over the top of the elevator assembly 18 as illustrated in FIG. 37 due to the low centre of gravity of the pins 12. The guides 123 also serve to direct the pins 12 laterally onto the pin support assembly 19 in the manner shown in FIG. 39.

Figure 40:
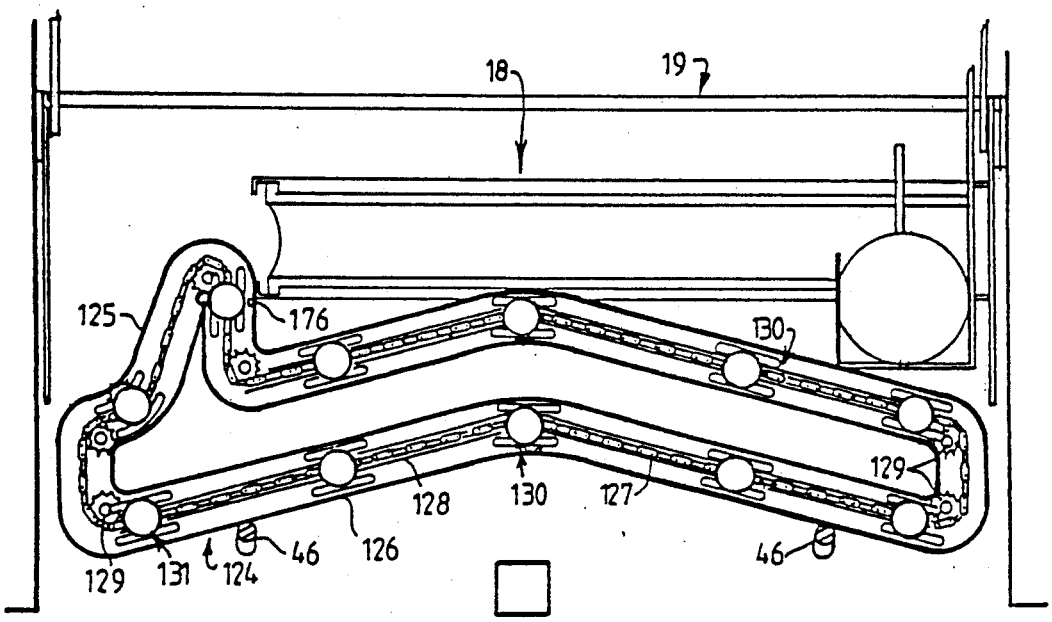
FIG. 40 is a plan view of the pin support assembly.
Figure 41:
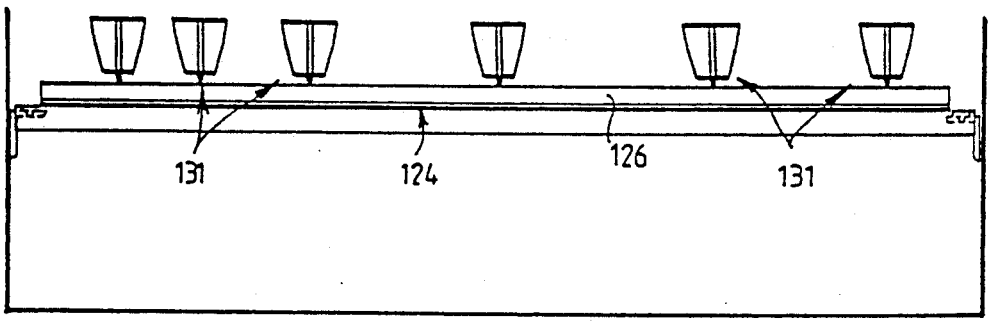
FIG. 41 is a side view of the pin support assembly.

The pin support assembly 19 includes a generally horizontal base plate 124 which includes an extended finger portion 125 which extends to a position adjacent the discharge point of the pin elevator assembly 18 and defines the profile for a pair of spaced apart upwardly extending flanges 126 which define tracks for the pin cups as defined below. An endless chain 127 is located is guides 128 between the tracks 126 in the manner shown in FIG. 40 and is supported by respective sprockets 129. Also located at spaced locations about the chain are pairs of stabilising members 130, the purpose of which will hereinafter become apparent.

Figure 42:
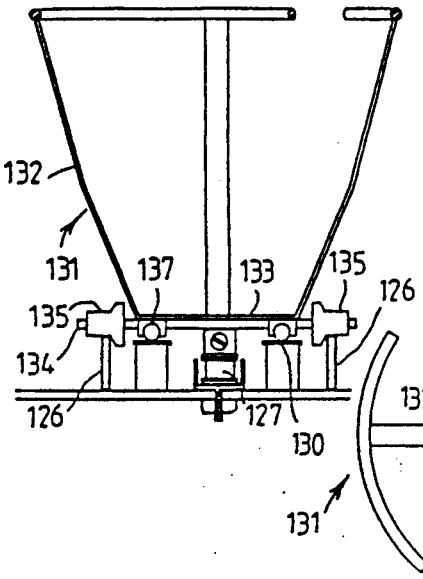
FIG. 42 is a front view of a pin receiving cup.
Figure 43:
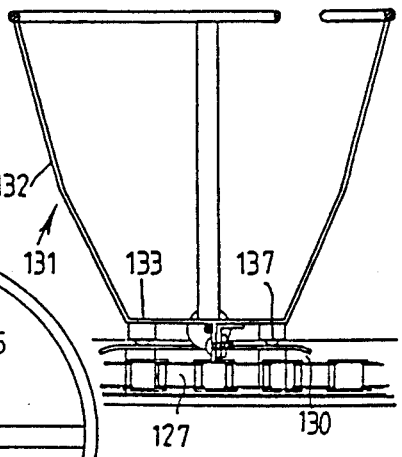
FIGS. 43 and 43 are side and plan views of the pin receiving cup.
Figure 45:
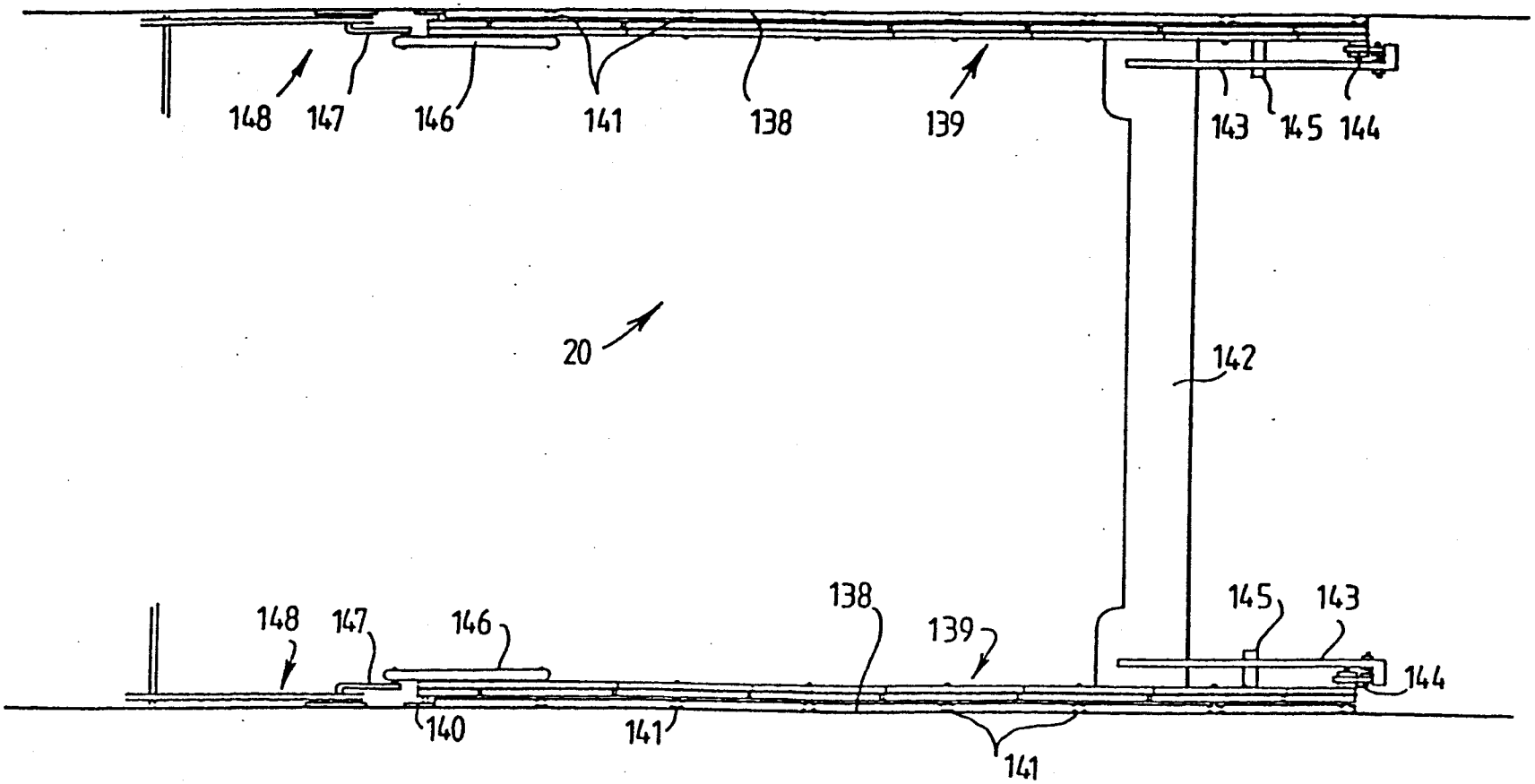
FIG. 45 is a plan view of the pin rake assembly in an extended inoperative position.
Figure 46:
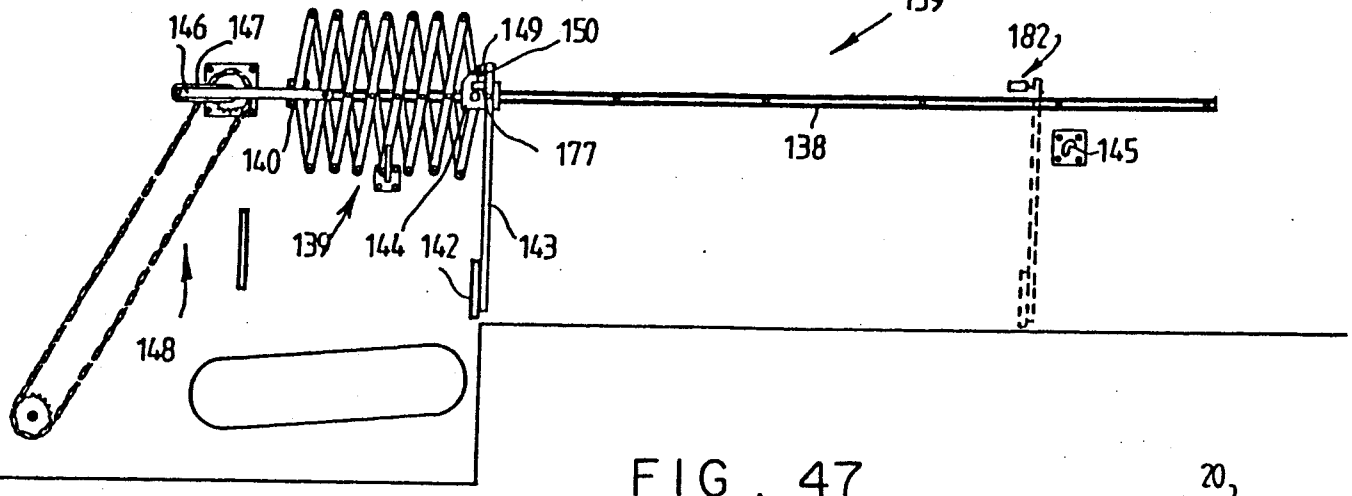
FIGS. 46 and 47 are side elevational views of the rake assembly in a retracted and extended position respectively.
Figure 47:
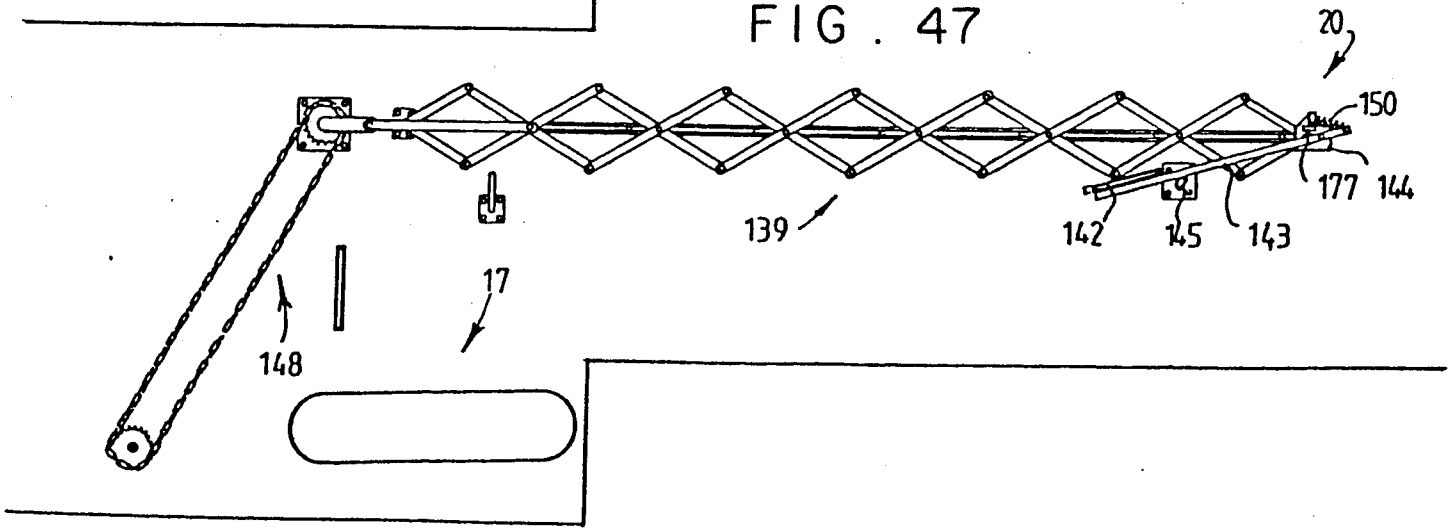

Movable with the chain 127 as shown in FIGS. 41 to 44 are eleven pin cups 131 which include an external frame 132 to locate about respective pins extending upwardly from a base member 133 which carries an axle 134 upon which are supported respective wheels 135 supported for rolling movement along the tracks 127. As shown in FIGS. 42 and 43, the base members 133 are connected to links of the chain 127 by brackets 136 and the base member 133 is also provided with further rollers 137 which in the positions of FIGS. 42 and 43 rest on the stabilising members 130 so that the cups 131 are supported in a stable attitude at these positions corresponding to pick up positions of the pins 12. The rake assembly 20 for removing pins 12 from the pin deck and depositing them onto the carpet assembly 17 includes as shown in FIGS. 45 to 47 a pair of tracks 138 which extend longitudinally along opposite sides of the lane 11 to be supported by the kickback. Supported and guided for movement along the opposite tracks 138 are respective scissor link assemblies 139 fixed at one end 140 adjacent the inner ends of the tracks 138 and including respective rollers 141 located within the tracks 138 which are preferably of C-sectioned form.

Extending between the leading ends of the link assemblies 139 is a transversally extending rake board 142 which is supported at the lower ends of respective arms 143 which are pivotally connected to support members 144 fixed to the scissor link assemblies 139. A pair of pivot pegs 145 are fixed to opposite kickbacks and project partway into the lane 11 as illustrated in FIG. 45. The link assemblies 139 are arranged to be expanded and retracted by an actuating shaft 146 pivotally mounted at opposite ends to the link assemblies 139 and a rotatable crank 147 which is rotated via a sprocket and chain assembly 148.

When drive is transmitted to the assembly 148, the link assemblies 139 are expanded as shown in FIG. 47 until the arms 143 strike the pegs 145 causing the rake board 142 and arms 143 to pivot upwardly as shown. Retraction of the link assemblies 139 will cause the rake board 142 and arms 143 to rotate to a vertical attitude where the arms 143 abut stops 149 on the supports 144 so that the rake board 142 may engage and sweep pins 12 from the pin deck onto the carpet assembly 17. The arms 143 are spring loaded to the vertical position by springs 150 the force of which is overcome by the arms 143 striking the pegs 145. Any balls 16 rolled down the lane 11 when the rake board 142 is in the FIG. 46 attitude will be arrested by the rake board due to the force applied by the springs 150.

Figure 48:
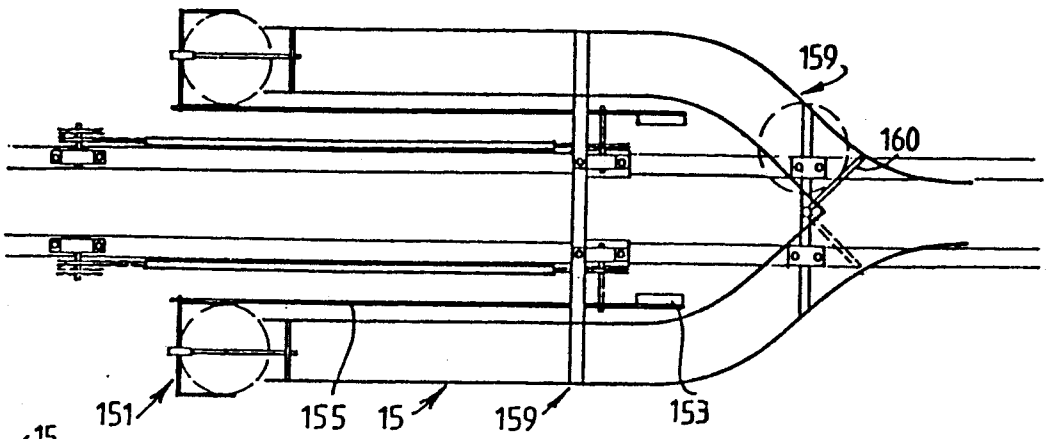
FIG. 48 is a plan view of the ball lifting assembly.
Figure 49:
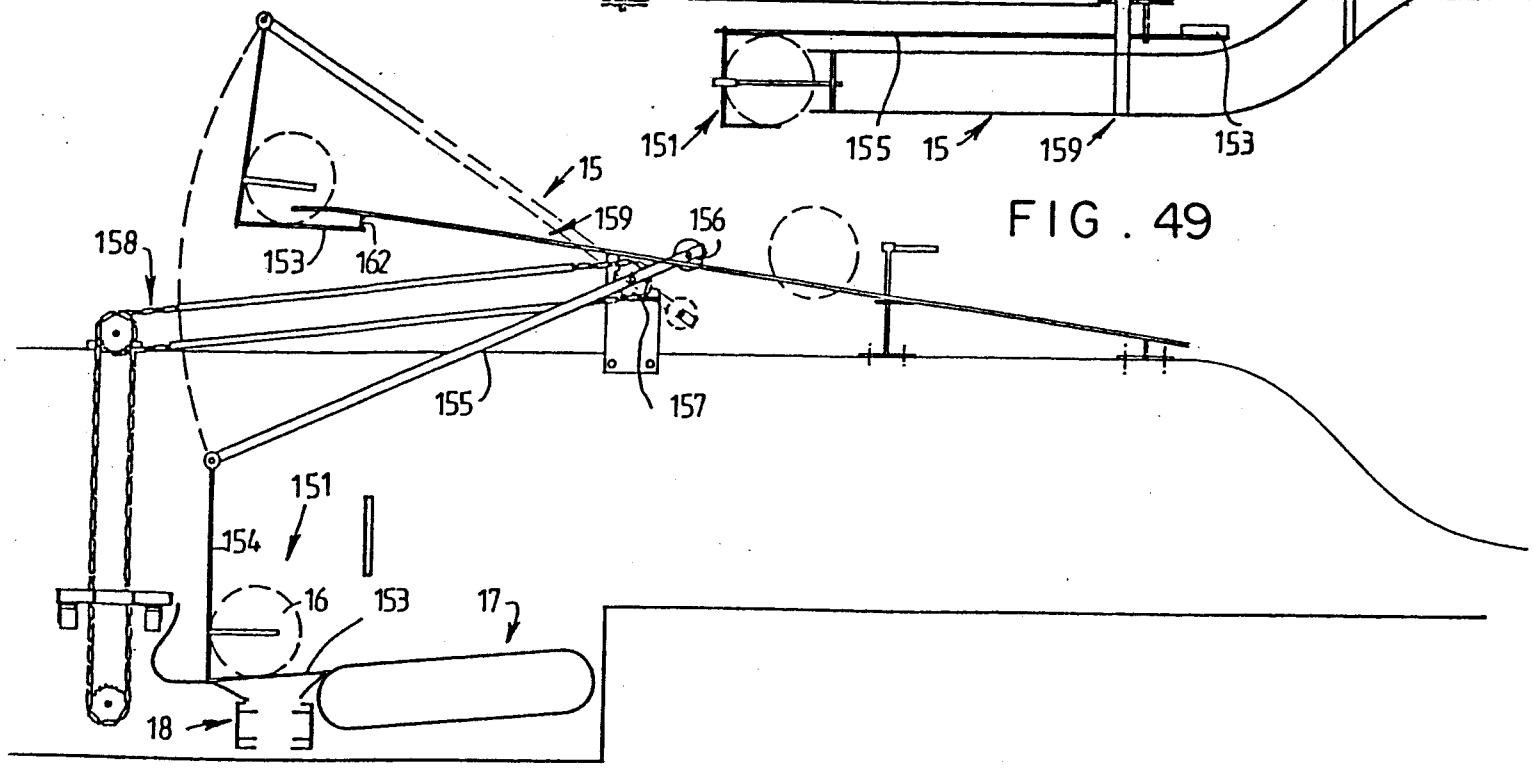
FIG. 49 is a side elevational view of the ball lifting assembly.
Figure 50:
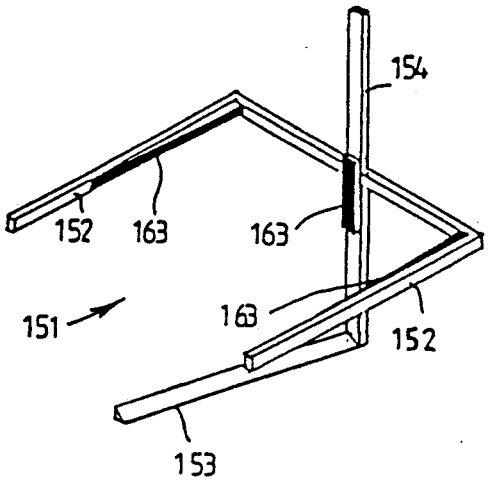
FIG. 50 shows details of the ball cradle.
Figure 51:
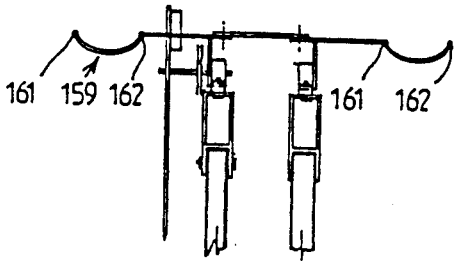
FIG. 51 is a sectional view showing details of the ball track associated with the ball lifting assembly.

The ball lifting assembly 15 as shown in FIGS. 48 and 49 includes a cradle 151 which comprises spaced side arms 152 and a base arm 153 for cradling the ball 16 is suspended by a further arm 154 pivotally connected to a pivotal lift arm 155 provided with a counterbalance 156 opposite the cradle 151. Fixed for movement with the arm 155 at its pivotal axis is a sprocket 157 coupled through a chain and sprockets transmission 158 to a drive source.

An inclined tracking bar assembly 159 extends from the upper position of the cradle 151 to the ball return conveyor (not shown) and as illustrated in FIG. 48, tracking bar assemblies 159 from adjacent lanes merge into one and at the point of joining a preferance bar 160 is provided which is pivotally switchable between adjacent assemblies 159 to avoid collision of balls 16 delivered by the tracking bar assemblies 159.

The tracking bar assemblies 159 comprise a pair of spaced bars 161 upon which the balls may be supported for rolling movement and the assemblies 159 are provided with a trip bar 162 at their upper ends which is engaged by the arm 153 of the cradle 151 when the latter is elevated so that the cradle 151 is pivoted and the ball 16 deposited onto the assembly 159 for return.

Actuation of the lifting assembly 15 for the ball occurs in response to receipt of a ball 16 in the cradle 151 which is sensed by means of microswitches 163 on the ball cradle arms. When the balls 16 are released onto the tracking bar assemblies 159, the switches 163 are opened which will remove drive to the lifting assembly 15 permitting the cradle 151 to return to its rest position awaiting ball receipt.

The balls 16 falling onto the carpet assembly 17 are guided into the cradle 151 by the pit cushion 164 which has a part circular cut out 165 aligned with the cradle 151 through which the balls 16 may pass.

Figure 52:
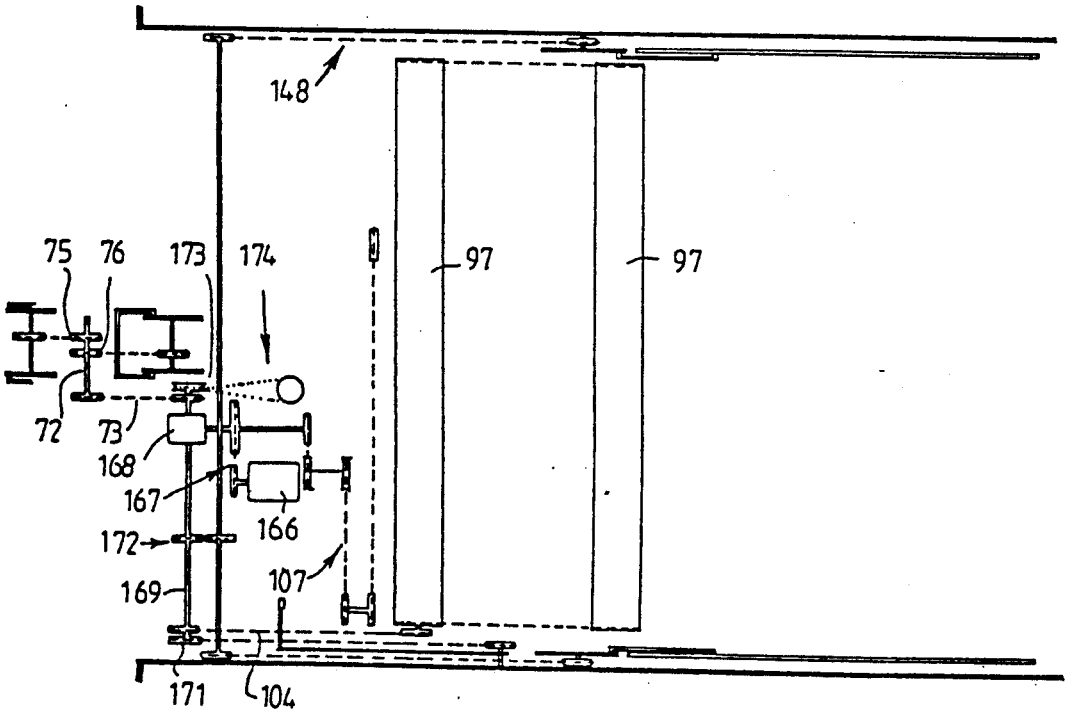
FIGS. 52 and 53 illustrates details of the drives for the apparatus.
Figure 53:
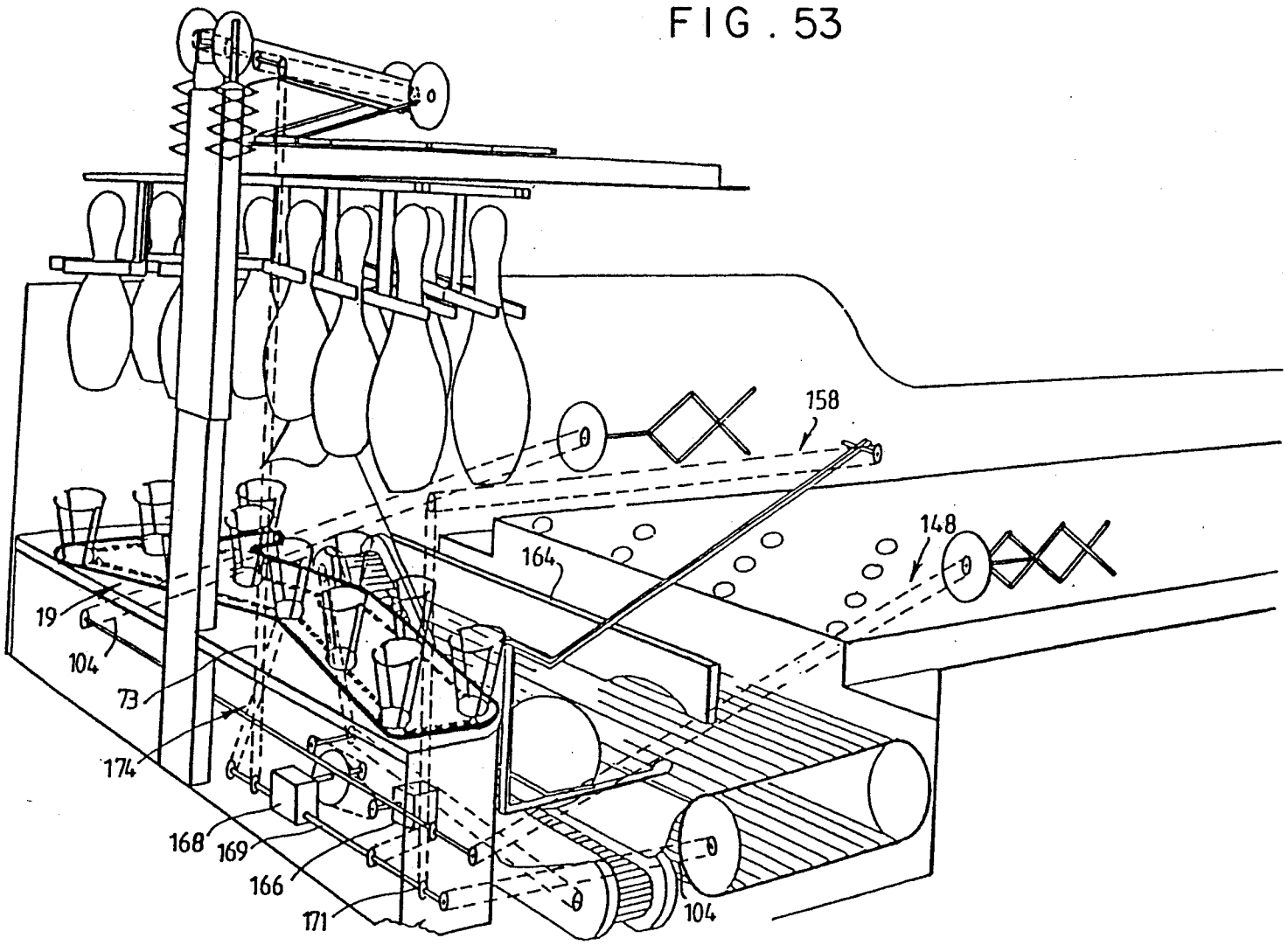
Figure 54:
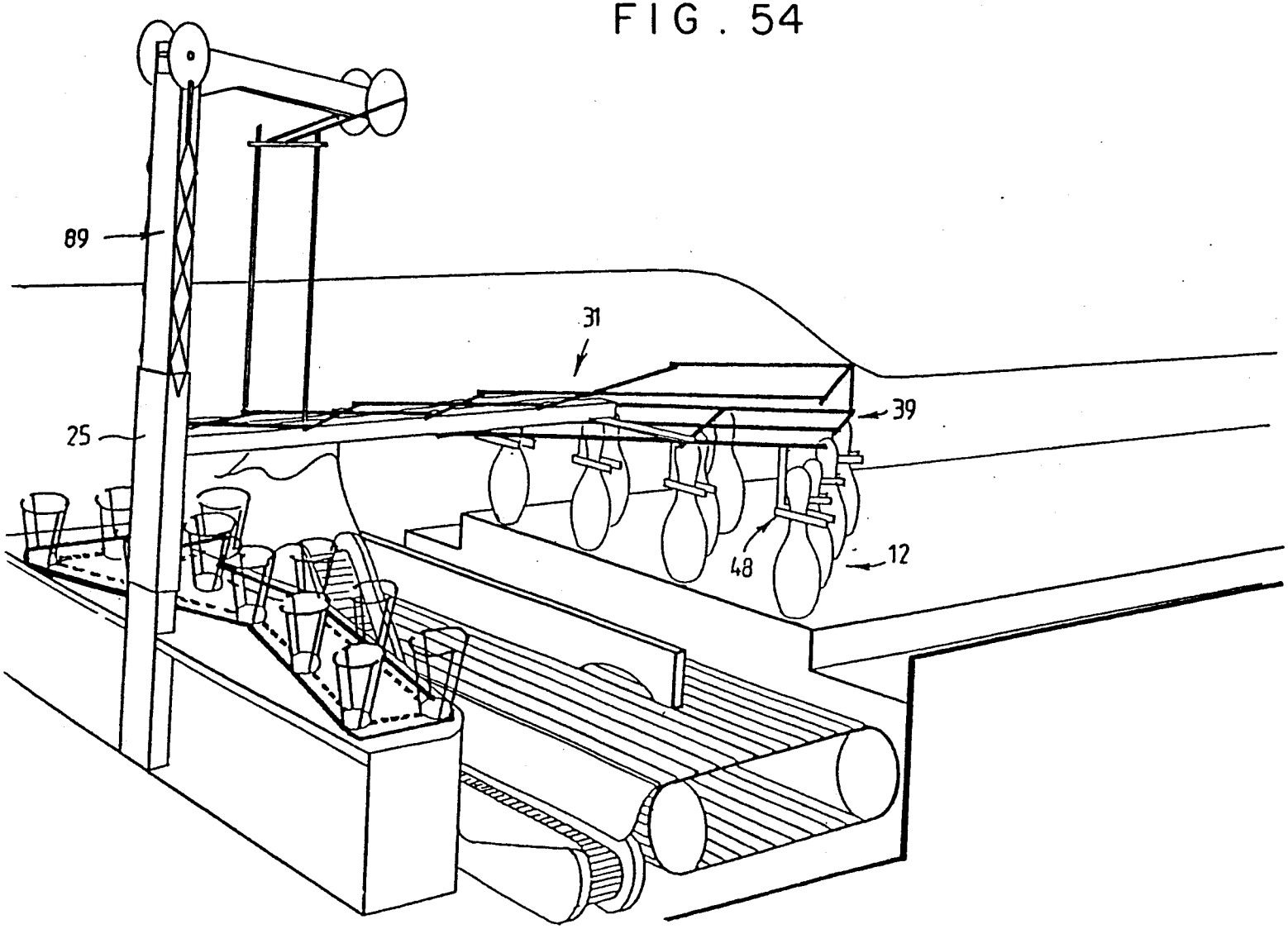
FIGS. 54 to 56 illustrate schematically the operation of the pin lifting mechanism of the apparatus.

Referring now to FIGS. 52 and 53, there is illustrated schematically the drive arrangement for the apparatus including the main drive motor 166 which is coupled through a sprocket/chain transmission 167 to a reducing gearbox 168 and through the sprocket/chain transmission 107 to the pin elevator assembly 18 which thus functions at all times that the motor 166 is operating. The gearbox 168 is coupled through a shaft 169 and sprocket 170 to the pin carpet drive chain 104 and via a magnetic clutch 171 with the ball lifting chain/sprocket drive 158. The gearbox 168 is also coupled via the chain/sprocket transmission associated magnetic clutch 172 with the chain/sprocket drive 148 for the rake assembly 139.

The gearbox 168 is further coupled via a magnetic clutch 173 and belt/pulley drive 174 with a drive sprocket 129 for the chain 127 of the pin support assembly 19. FIGS. 52 and 53 also show coupling of the gearbox via the chain 73 to the drive mechanism drive shaft 72 and clutches 75 and 76.

In use and as shown in FIGS. 1, 54, 55 and 56, and assuming that ten pins 12 are located in their set FIG. 1 position on the pin deck, the bowler may bowl a ball 16 normally causing some or all of the pins 12 on the pin deck to be knocked onto the moving pit carpet 93 where they are directed onto the moving pin elevator asembly 18 for elevation and depositing onto the pin support assembly 19 via chute 123.

A microswitch 175 (see FIG. 36) is supported adjacent the chute 123 and is actuated when a pin 12 passes through the chute 123 towards the pin cup 131 positioned in the extended finger portion 125 of the tracks 126. Tripping of the switch 175 causes the clutch 173 to be actuated to transmit drive to the chain 127 to move the next cup 131 into position for receipt of a pin. Movement of respective cups 131 to this position actuates a microswitch 176 (see FIG. 40) which will cause the clutch 173 to be turned off. Respective microswitches associated with each cup 131 indicate the presence or absence of a pin 12 so that a full cup 131 will not move to the "charge" position.

When the bowled ball 16 strikes the pin cushion 164, a microswitch actuated by the consequent movement of the pin cushion 164 will cause the rake magnetic clutch 171 to be activated. This will cause drive to be transmitted to the crank 147 causing the linkages 139 to be retracted so that the rake arms 143 are pulled off the pegs 145 to adopt the vertical attitude. This will trigger a microswitch 177 on the rake supports 144 causing the clutch 171 to turn off so that the rake 142 is in a ball blocking attitude (shown in dotted outline in FIG. 46).

Activation of the switch 177 will also cause the drive magnetic clutch 75 to be actuated so that the linkage assembly 31 expands carrying with it along the gantry 27 the pin linkage assembly 39 through the drive arm 38.

The carriage 41 strikes a stop 178 (see FIG. 5) at the outer end of the gantry 27 to cause the linkage asembly 39 to expand on continued movement to the FIG. 12 attitude. This position is sensed by a microswitch 179 (see FIG. 7) causing the clutch 75 to be turned off and the clutch 76 on. This also releases the latch solenoid 91 so that the cranks 87 are rotated to expand the linkages 89 and lower the riser member 25 to FIG. 54 position. At the bottom of the stroke sensed by a microswitch 180 (see FIG. 24), the jaw solenoid 69 actuated to close the jaws 49 and 50 of the pin grippers 48 to grasp and standing pins 12 after which the linkages 89 are retracted to elevate the riser member 25 to the FIG. 22 attitude which actuates a microswitch 181 (see FIG. 23) to cause the latch 91 to close on the lug 92 and the clutch 76 to be turned off.

Actuation of this switch 181 also causes the rake clutch 171 to re-engage so that the linkages 139 retract causing the rake board 142 to sweep pins 12 onto the pit carpet assembly 17. Continued rotation of the rake crank 147 moves the rake board 142 back to intermediate guard position as sensed by a switch 182 which will cause the clutch 171 to activate, the clutch 76 to actuate to release the latch 91 and lower the riser member 25 so that the pins 12 are reset on the pin deck where the jaws 49 and 50 are released due to actuation of the switch 180 (see FIG. 54). Drive is continued to the linkages 89 so that the riser member 25 is returned to its upper position of FIG. 22 after which the linkages 31 are retracted due to actuation of the switch 181 causing clutch 75 actuation.

When the linkages 31 are fully retracted, the clutch 75 is disengaged due to actuation of the switch 179. This will re-engage the rake clutch 171 to return the rake to its extended position of FIG. 47 where the clutch is turned by actuation of switch 177 off so that the bowler may bowl his next ball 16 which has been returned to the bowler in the manner described with reference to FIGS. 48 to 51.

Figure 55:
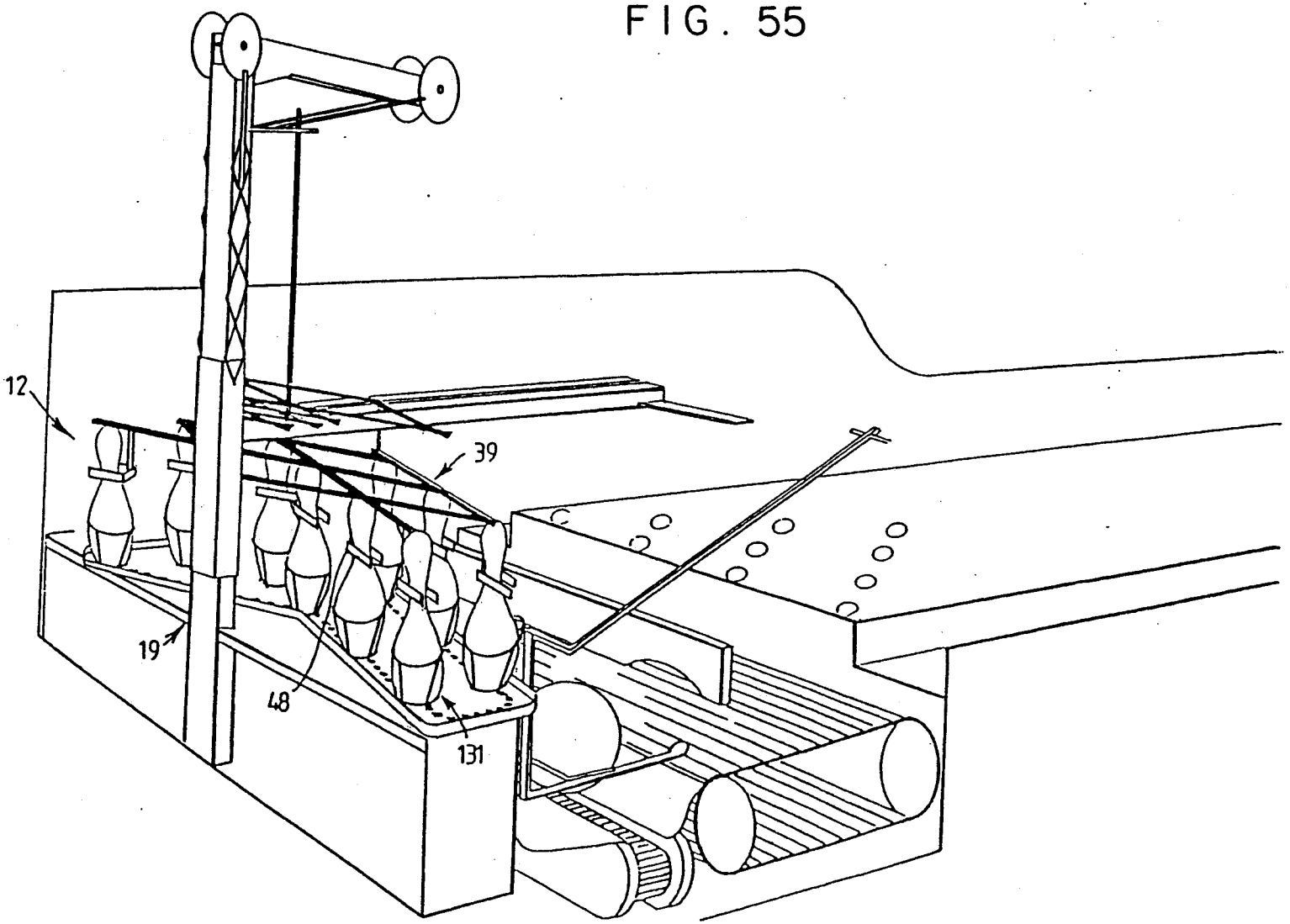
Figure 56:
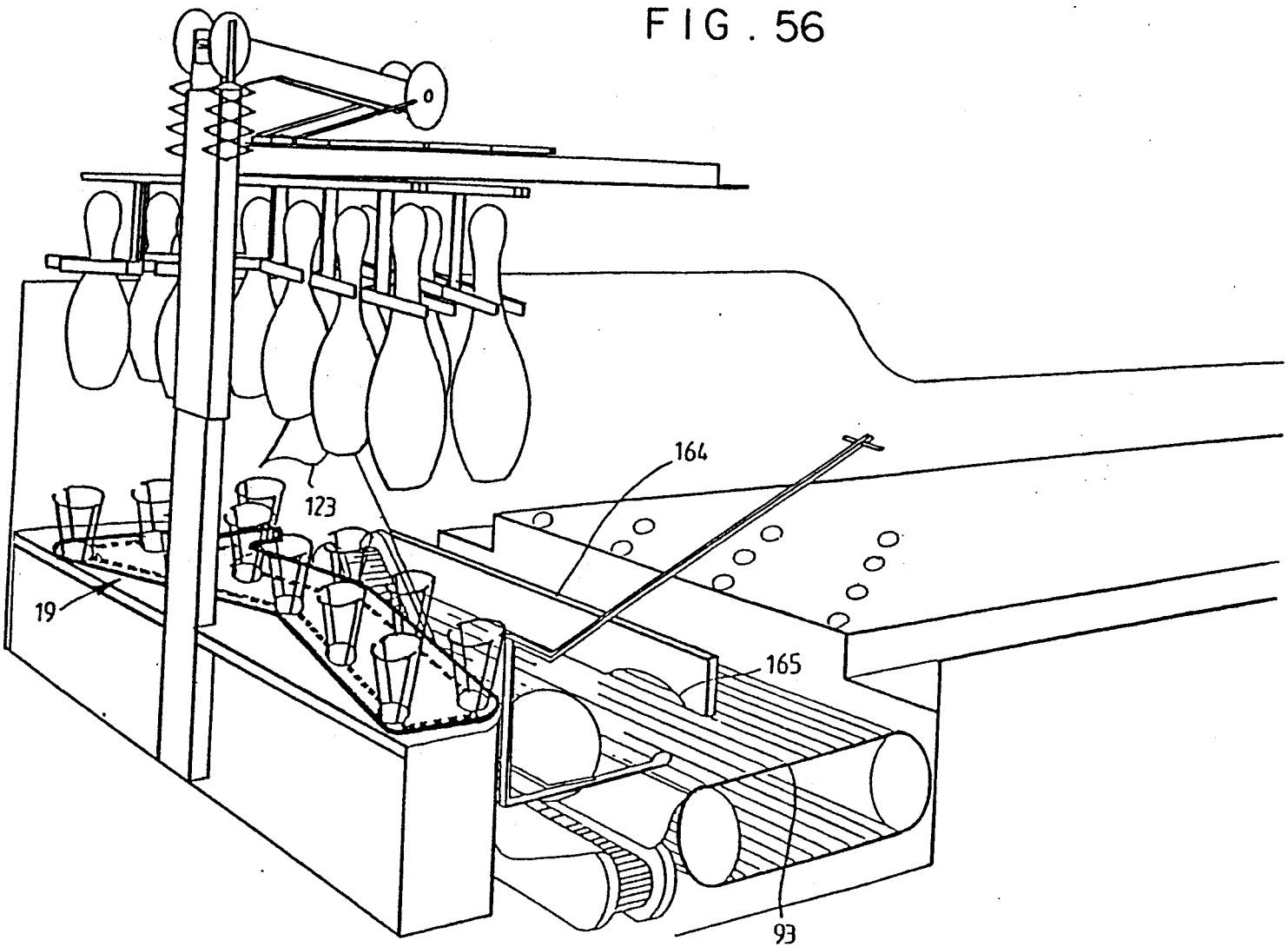

If a strike occurs, the microswitches 66 of the pin grippers 57 will be actuated so that the pin setter is placed in the strike cycle mode. When the riser member 25 reaches the top position, the clutch 76 will switch off through actuation of the switch 181 and the clutch 75 actuated to withdraw the linkages 31 so that the pin linkages 39 move to the FIG. 11 position. The clutch 76 will then reactivate to lower the linkages 39 over the pin support assembly 19 so that the pin grippers 48 can pickup pins 12 from the pin cups 131 which are aligned with respective grippers 48 (as shown in FIG. 55). At the same time, the rake clutch 171 will activate so that the rake 72 will sweep the pin deck and assume the intermediate guard position. The riser member 25 is returned to the top position of FIG. 56 after which the linkage assemblies 31 and 39 are extended, the riser member 25 lowered and the pins 12 deposited on the pin deck. The riser member 25 then retracts as do the linkages 31 and 39. At the upper position the clutches 75 and 76 are turned of after retraction and the rake clutch 171 actuated to move the rake assembly to the FIG. 47 position awaiting the next ball.

The respective jaws 49 and 50 of the pin grippers 48 are designed to have a double grip on each side of the neck of the pin so that the pins will not move during transportation over the pin deck. To prevent any surplus pins 12 being elevated by the elevator assembly 18 a knock back bar 182 is located above the elevator 108 to knock excess pins onto the carpet assembly 17 where they may be directed to a spare bay between cups 114.

The drive for elevating and lowering the riser member may comprise a rack and pinion drive, simple crank or cam drives, or cable and pulley drive. Furthermore, the linkages 31 if desired may be located in a vertical or horizontal plane to be actuated in any of the above described manners. In yet a further configuration the gantry 27 may be replaced by an arm pivotally connected to the stem for movement about a vertical axis across the pin deck with the arm carrying pin gripping mechanisms. If desired the stem 13 itself may be supported for vertical movement and carry a fixed gantry and be actuated by any of the above mechanical drives or the arm may be raised or lowered for pin engagment.

In an alternative configuration, the riser stem 13 and associated pin lifting and depositing devices may be located to one side of the pin deck for example adjacent the kick back to function in a similar manner to that described above.

In yet a further configuration a plurality of upstanding stems may be located to one side of the pin deck and support respective pivotal arms each of which carry pin grippers corresponding to different rows of pins. The arms may thus be pivoted across the pin deck so that the respective grippers which may be mounted to scissor linkages may deposit or pick up pins. The arms may be moved by cranks, cables or other mechanisms to elevate or lower pins as desired.

It will be apparent that the apparatus described above may be controlled in accordance with normal functions required for ten pin bowling and that actuation or non actuation of the gripper microswitches 66 may indicate via lights the number of pins which remain on the deck if any. Indication of a foul or the first ball will be indicated by actuation of the cradle microswitches. Many other variations and modifications may be made to the apparatus without departing from the broad scope and spirit of the invention.

Suitably, all operations of the apparatus are controlled by a proportional logic controller associated with the respective microswitches and sensitive to actuation thereof. Preferably also an override system is provided so that a player may select certain pins to be set on the deck by controlling which cups 131 are loaded with pins.

I claim:

1. Pin setting means for use with a ten pin bowling apparatus of the type including a bowling lane and a pin deck at the end of said lane for supporting ten pins thereon, said pin setting means including a linkage assembly comprising a plurality of pivotally interconnected link members, at least some of said link members being interconnected to form a parallelogram linkage structure, pin engaging means supported at spaced apart positions on said linkage assembly, linkage supporting means for supporting said linkage assembly for movement between a first attitude overlying said pin deck and a second attitude wherein said linkage assembly is moved away from said pin deck, said linkage supporting means including substantially horizontal guide means adapted to extend longitudinally of said bowling lane, carriage means mounted for movement along said guide means and supporting one end of said linkage assembly and actuating means connected to the opposite end of said linkage assembly, said actuating means including a plurality of pairs of cross linkage members pivotally interconnected intermediate their ends and to the linkage members of adjacent pairs of linkage members, a plurality of support carriages supported for movement along said guide means and supporting said linkage members, and stop means on said guide means, said actuating means being actuable for moving said linkage assembly between said first and second attitudes, said stop means being engaged by said carriage means when said linkage assembly is moved towards said second attitude and wherein movement of the other end of said linkage assembly by said actuating means subsequent to said carriage means engaging said stop means causing said linkage assembly to move to an expanded position wherein said pin engaging means are disposed at locations corresponding to desired positions of said pins on said pin deck to enable deposit of pins thereon or collection of pins therefrom, said actuating means being further actuable to move said linkage assembly from said first to said second attitude and into a contracted position wherein pins may be collected by said pin engaging means from pin supporting means.

2. Pin setting means according to claim 1 wherein said guide means extends outwardly from an upstanding support structure adapted to be disposed at the rear of said pin deck.

3. Pin setting means for use with a ten pin bowling apparatus of the type including a bowling lane and a pin deck at the end of said lane for supporting ten pins thereon, said pin setting means including a linkage assembly comprising a first pair of parallel linkage members and a second pair of parallel linkage members, the linkage members of said first pair being pivotally interconnected at their opposite ends to opposite ends of said linkage members of said second pair, and a pair of intermediate linkage members pivotally interconnected intermediate their respective ends and wherein one of said intermediate linkage members is disposed between and extends parallel to the linkage members of said first pair of parallel linkage members and is pivotally interconnected at its opposite ends to the respective linkage members of said second pair of parallel linkage members and wherein the other of said intermediate linkage members is disposed between and extends parallel to the linkage members of said second pair of parallel linkage members and is pivotally interconnected at its opposite ends to respective linkage members of said first pair of parallel linkage members, pin engaging means supported at spaced apart positions on said linkage assembly, means for supporting said linkage assembly for movement between a first attitude overlying said pin deck and a second attitude wherein said linkage assembly does not overly said pin deck, and means for expanding and contracting said linkage assembly so as to move said linkage assembly between an expanded attitude wherein said pin engaging means are disposed at positions corresponding to desired positions of said pins on said pin deck to enable deposit of pins thereon or collection of pins therefrom, and a contracted attitude wherein pins may be collected by said pin engaging means from pin supporting means.

4. Pin setting means according to claim 3 wherein a further pair of linkage members is pivotally connected to respective adjacent linkage members of said first and second pairs, each of the further pair of linkage members supporting respective further pin engaging means, biasing means associated with each of said further pair of linkage members and adapted to bias said further pair of linkage members to a position wherein said further pin engaging means are aligned with further desired pin locations on said pin deck when said linkage assembly is in said expanded attitude and stop means engageable by said further pair of linkage members when said linkage assembly is moved to said contracted attitude and into said second attitude and causing said further pair of linkage members to move to a position wherein said further pin engaging means are aligned with said pin supporting means.

5. Pin setting means according to claim 3 and including substantially horizontal guide means adapted to extend longitudinally of said bowling lane, said guide means being adapted to guide said linkage assembly between said first and second attitudes.

6. Pin setting means according to claim 5 and including carriage means mounted for movement along said guide means and supporting one end of said linkage assembly and actuating means connected to an opposite end of said linkage assembly and actuable to move said linkage assembly between said first and second attitudes, and for causing said linkage assembly to move between said expanded and contracted attitudes.

7. Pin setting means according to claim 6 and including means or supporting said actuating means for movement along said guide means and wherein said guide means includes stop means adapted to be engaged by said carriage means when said linkage assembly is moved away from said first attitude towards said second attitude by said actuating means, and wherein movement of the other end of said linkage assembly by said actuating means subsequent to said carriage means engaging said stop means causes said linkage assembly to move to said expanded attitude.

8. Pin setting means according to claim 7 wherein said actuating means includes a linkage assembly comprised of a plurality of pairs of pivotally interconnected cross linkages and wherein said means for supporting said actuating means include a plurality of support carriages supported for movement along said guide means.

9. Pin setting means according to claim 8 wherein said guide means extends outwardly from an upstanding support structure adapted to be disposed at the rear of said pin deck, and there being provided means for moving said guide means in opposite directions along said support structure for raising or lowering said linkage assembly and said pin engaging means.

10. Pin setting means according to claim 9 wherein said support structure includes an upstanding support member adapted to be disposed centrally of said pin deck, slide means engaged with said support member and movable therealong, said slide means supporting said guide means and actuating means for causing reciprocation of said slide means along said support member.

11. Pin setting means according to claim 3 wherein each said pin engaging means includes a pair of pivotally interconnected jaws, and there being provided jaw actuating means for actuating said jaws so as to cause said jaws to move relatively towards and away from each other so as to enable gripping or release of said pins.

12. Pin setting means according to claim 11 wherein said jaw actuating means includes chain means extending about said linkage assembly and supported thereon, means interconnecting said chain means and said jaws, and means for moving said chain means relative to said linkage assembly so as to cause opposite movement of said jaws.

13. Pin setting means according to claim 3 wherein said pin supporting means includes a plurality of pin supporting members adapted to support pins in an upstanding attitude, said pin supporting members being arranged for movement along a guide and being adapted to be substantially aligned with respective pin engaging means when said linkage assembly is contracted and disposed in said second attitude.

14. Pin setting means according to claim 13 wherein said guide comprises an endless track and there being provided means interconnecting respective pin supporting members and drive means for causing said pin supporting members to be moved concurrently along said track.

15. Pin setting means according to claim 14 and including pin collection and elevating means adapted to receive pins from said pin deck and move said pins to a generally upright attitude whereby said pins may be deposited onto said respective pin supporting members.

16. Pin setting means according to claim 15 wherein said pin collection and elevating means includes a conveyor having a plurality of spaced apart elements thereon defining therebetween respective receiving compartments for pins and wherein said conveyor includes an inclined portion whereby pins in said compartments upon movement therealong are raised towards an upright attitude for depositing onto said supporting members.

17. Pin setting means according to claim 16 and including pit carpet means adapted to direct pins displaced from said pin deck towards said conveyor, said pit carpet means including a pair of spaced apart horizontal rollers supporting thereabout an endless carpet, respective sprockets disposed at corresponding ends of said rollers for movement therewith, an endless chain disposed about said sprockets and means securing an edge portion of said carpet to said chain.

18. Ten pin bowling apparatus including pin setting means according to claim 3 and a ball return mechanism, said ball return mechanism including cradle means for receiving a ball bowled down said lane, inclined track means for returning said ball, and means for elevating said cradle means so as to enable said ball to be deposited onto said track means.

19. Pin setting means according to claim 3 and including a pin raking mechanism adapted to be actuated to rake fallen pins rearwardly from said pin deck, said raking mechanism including a raking arm extending transversely of said lane, means for advancing and retracting said raking arm along said lane and stop means adapted to be engaged by said raking arm when said arm is retracted so as to cause said raking arm to be lifted from said pin lane to an inoperative attitude.

20. Pin setting means for use with a ten pin bowling apparatus of the type including a bowling lane and a pin deck at the end of said lane for supporting ten pins thereon, said pin setting means including a linkage assembly comprising a plurality of pivotally interconnected link members, at least some of said link members being interconnected to form a parallelogram linkage structure comprising a first pair of parallel link members and a second pair of parallel link members, the link members of said first and second pair being of substantially the same length, the link members of said first pair being pivotally interconnected at their opposite ends to opposite ends of the link members of said second pair, pin engaging means supported at spaced apart positions on said linkage assembly, means for supporting said linkage assembly for movement between a first attitude overlying said pin deck and a second attitude wherein said linkage assembly does not overly said pin deck, and means for expanding and contracting said linkage assembly so as to move said linkage assembly between an expanded attitude wherein said pin engaging means are disposed at positions corresponding to the desired positions of said pins on said pin deck to enable deposit of pins thereon or collection of pins therefrom, and a contracted attitude wherein pins may be collected by said pin engaging means from pin supporting means, opposite pivotal connections between respective link members of said pairs of parallel link members being moved towards and away from each other upon expansion and contraction of said linkage assembly.

21. Pin setting means according to claim 20 and including substantially horizontal guide means for guiding movement of said linkage assembly between said first and second attitudes, carriage means movable along said guide means and supporting said linkage assembly adjacent one said pivotal connection and actuating means coupled to said linkage assembly adjacent the pivotal connection opposite said one pivotal connection.

22. Pin setting means according to claim 21 wherein said guide means includes stop means in the path of movement of said carriage means, and wherein operation of said actuating means causes advancement of said linkage assembly along said guide means towards said second attitude and movement of said linkage assembly to said expanded attitude upon said carriage means engaging said stop means.

* * * * *